US012290214B2

(12) United States Patent
Lewis

(10) Patent No.: US 12,290,214 B2
(45) Date of Patent: May 6, 2025

(54) ELECTRONIC TOWEL DISPENSER WITH LOW POWER MODE

(71) Applicant: Kimberly-Clark Worldwide, Inc., Neenah, WI (US)

(72) Inventor: Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 220 days.

(21) Appl. No.: 17/771,346

(22) PCT Filed: Oct. 31, 2019

(86) PCT No.: PCT/US2019/059151
§ 371 (c)(1),
(2) Date: Apr. 22, 2022

(87) PCT Pub. No.: WO2021/086378
PCT Pub. Date: May 6, 2021

(65) Prior Publication Data
US 2022/0346606 A1 Nov. 3, 2022

(51) Int. Cl.
*A47K 10/36* (2006.01)
*A47K 10/32* (2006.01)

(52) U.S. Cl.
CPC .. *A47K 10/3625* (2013.01); *A47K 2010/3253* (2013.01); *A47K 2010/365* (2013.01)

(58) Field of Classification Search
CPC ..... A47K 10/3625; A47K 2010/3253
See application file for complete search history.

(56) References Cited

U.S. PATENT DOCUMENTS 7,793,882 B2 9/2010 Reinsel et al.
7,987,756 B2 8/2011 Lewis et al.
(Continued)

FOREIGN PATENT DOCUMENTS

CA 2448331 A1 4/2005
CN 101068494 A 11/2007
(Continued)

OTHER PUBLICATIONS

O'Brien, Brendan, "Toilet Tissue Dispensers Join The Touch-free Restroom", Cleanlink, https://www.cleanlink.com/sm/article/Toilet-Tissue-Dispensers-Join-The-Touch-free-Restroom--14811.
(Continued)

*Primary Examiner* — Liang Dong
(74) *Attorney, Agent, or Firm* — KIMBERLY-CLARK WORLDWIDE, INC.

(57) ABSTRACT

Electronic towel dispensers and methods of operation disclosed. In one embodiment, a towel dispenser for dispensing web material from a roll of web material may comprise a housing comprising a back panel and a front cover and having an internal volume so as to retain at least one roll of web material therein, an electronically powered dispensing mechanism contained within the housing for dispensing web material from the roll of web material upon actuation of said dispensing mechanism, a tear bar disposed within the housing, the tear bar comprising a tear bar back edge and a tear bar cutting edge, and a tear bar actuator coupled to the tear bar and configured to move the tear bar between a tear bar primary position and a tear bar secondary position.

11 Claims, 14 Drawing Sheets

(56) References Cited

U.S. PATENT DOCUMENTS

| | | | | |
|---|---|---|---|---|
| 8,082,827 | B2 | 12/2011 | Friesen et al. | |
| 8,146,471 | B2 | 4/2012 | Hansen et al. | |
| 8,160,742 | B2 | 4/2012 | Goerg et al. | |
| 8,528,851 | B2 | 9/2013 | Friesen et al. | |
| 8,833,691 | B1 | 9/2014 | Zosimadis | |
| 9,999,326 | B2 | 6/2018 | Borke et al. | |
| 2007/0079684 | A1* | 4/2007 | Friesen | B26D 1/42 83/649 |
| 2013/0193258 | A1 | 8/2013 | Keily et al. | |
| 2016/0227970 | A1 | 8/2016 | Diamond | |
| 2016/0325957 | A1* | 11/2016 | Borke | A47K 10/36 |
| 2016/0374519 | A1 | 12/2016 | Murphy | |
| 2018/0263433 | A1 | 9/2018 | Osborne, Jr. | |

FOREIGN PATENT DOCUMENTS

| | | | | |
|---|---|---|---|---|
| CN | 101522085 | A | 9/2009 | |
| CN | 201398926 | Y | 2/2010 | |
| CN | 101896107 | A | 11/2010 | |
| CN | 203914750 | U | 11/2014 | |
| CN | 106231968 | A | 12/2016 | |
| CN | 206700099 | U | 12/2017 | |
| CN | 108378758 | A | 8/2018 | |
| CN | 208463925 | U | 2/2019 | |
| EP | 1535559 | A1 * | 6/2005 | A47K 10/3643 |
| WO | 2013043179 | A1 | 3/2013 | |

OTHER PUBLICATIONS

Tork, "Tork Electronic Hand Towel Roll Dispenser", https://www.torkusa.com/product/771828/dispenser/hand_towel/.

* cited by examiner

ELECTRONIC TOWEL DISPENSER WITH LOW POWER MODE

TECHNICAL FIELD

The present disclosure relates generally to the field of towel dispensers for dispensing lengths of web material from a roll, and more particularly to electronic towel dispensers which have multiple modes of operation.

BACKGROUND OF THE DISCLOSURE

Electronic towel dispensers are well known in the art, including dispensers that automatically dispense lengths of web material upon sensing the presence of a user. This type of dispenser has become known in the art as a "hands-free" dispenser in that it is not necessary for the user to manually actuate or otherwise handle the dispenser to initiate a dispense cycle. The control systems and mechanical aspects of conventional hands-free dispensers are wide and varied.

Many electronic towel dispensers rely on battery power as a primary power source. According to some current electronic web material dispensers, when their associated batteries deplete to a predetermined level, such dispensers cease automatically dispensing lengths of web material. Improvements to allow for dispensing of web material, or easier dispensing of web material, in electronic towel dispensers where the batteries have been depleted remain an area of desire in the art.

SUMMARY OF THE DISCLOSURE

The present disclosure relates generally to the field of towel dispensers for dispensing lengths of web material from a roll, and more particularly to electronic towel dispensers that have multiple modes of operation.

In a first embodiment, a towel dispenser for dispensing web material from a roll of web material may comprise a housing comprising a back panel and a front cover and having an internal volume so as to retain at least one roll of web material therein, an electronically powered dispensing mechanism contained within the housing for dispensing web material from the roll of web material upon actuation of said dispensing mechanism, a tear bar disposed within the housing, the tear bar comprising a tear bar back edge and a tear bar cutting edge, and a tear bar actuator coupled to the tear bar and configured to move the tear bar between a tear bar primary position and a tear bar secondary position.

In a second embodiment, a towel dispenser for dispensing web material from a roll of web material may comprise a housing comprising a back panel and a front cover and having an internal volume so as to retain at least one roll of web material therein, an electronically powered dispensing mechanism contained within the housing for dispensing web material from the roll of web material upon actuation of said dispensing mechanism, a tear bar disposed within the housing, the tear bar comprising a tear bar back edge and a tear bar cutting edge, and a tear bar actuator coupled to the tear bar and configured to move the tear bar between a tear bar primary position and a tear bar secondary position. In some further aspects, when the tear bar is in the tear bar primary position, the tear bar cutting edge may intersect a path the web material follows within the towel dispenser when the web material is subjected to a downward force and when the tear bar is in the tear bar secondary position, the tear bar cutting edge may not intersect the path the web material follows within the towel dispenser when the web material is subjected to a downward force.

In a third embodiment, a method of operating a towel dispenser for dispensing web material from a roll of web material may comprise monitoring, with control circuitry, a battery voltage value of one or more batteries of the towel dispenser and, after determining the battery voltage value is equal to or less than a tear bar threshold battery voltage value, moving a tear bar of the towel dispenser from a tear bar primary position within the towel dispenser to a tear bar secondary position within the towel dispenser.

The above summary of the present disclosure is not intended to describe each embodiment or every implementation of the present disclosure. Advantages and attainments, together with a more complete understanding of the disclosure, will become apparent and appreciated by referring to the following detailed description and claims taken in conjunction with the accompanying drawings.

BRIEF DESCRIPTION OF DRAWINGS

The disclosure may be more completely understood in consideration of the following detailed description of various embodiments in connection with the accompanying drawings, in which.

Figure 1:
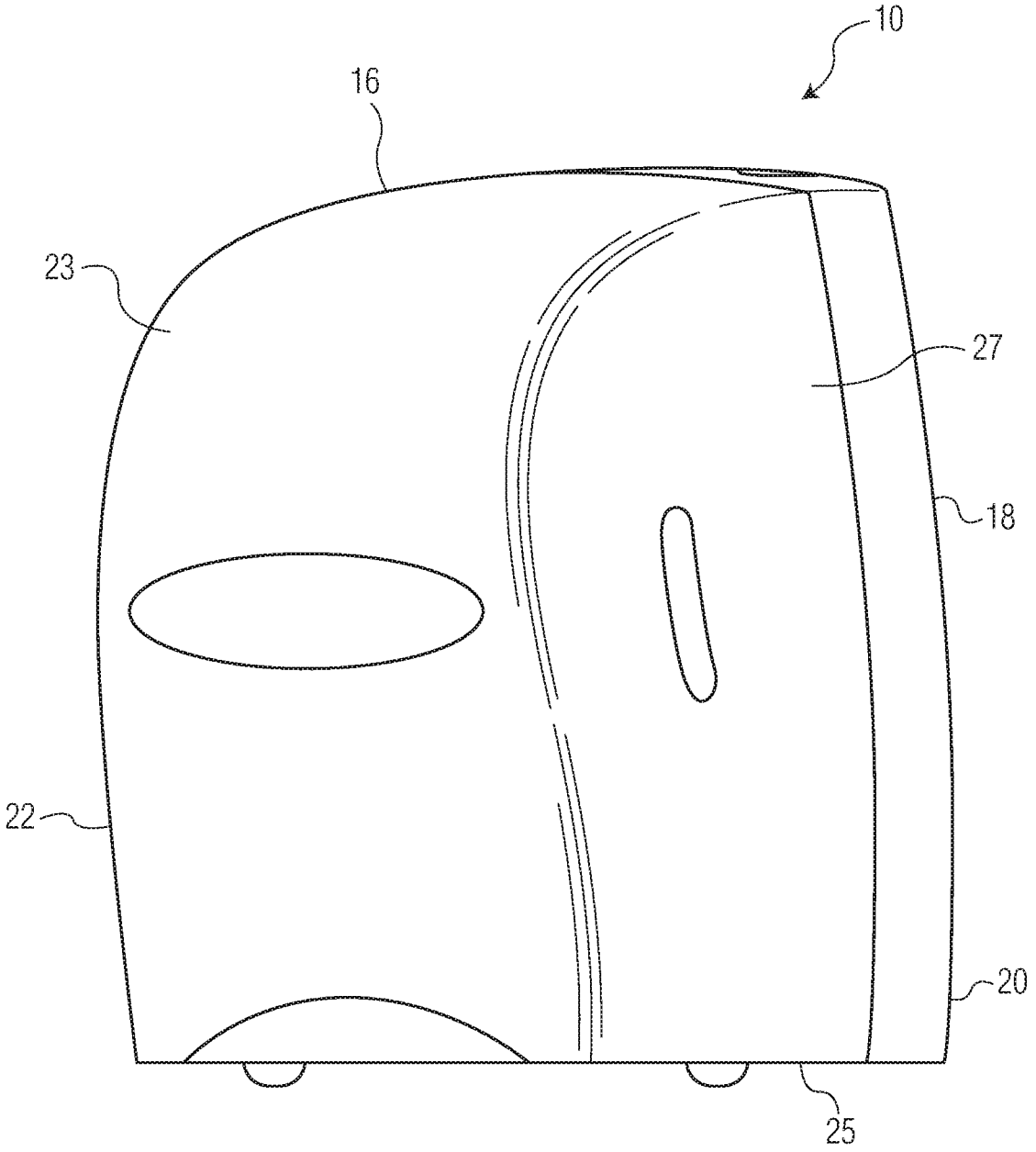
FIG. 1 is a perspective view of an electronic towel dispenser according to aspects of the present disclosure.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the scope of the disclosure.

DETAILED DESCRIPTION OF THE DISCLOSURE

The following description should be read with reference to the drawings in which similar elements in different drawings are numbered the same. The description and the drawings, which are not necessarily to scale, depict illustrative embodiments and are not intended to limit the scope of the disclosure.

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

Each example is provided by way of explanation and is not meant as a limitation. For example, features illustrated or described as part of one embodiment or figure can be used on another embodiment or figure to yield yet another embodiment. It is intended that the present disclosure include such modifications and variations.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Many modifications and variations of the present disclosure can be made without departing from the spirit and scope thereof. Therefore, the exemplary embodiments described above should not be used to limit the scope of the invention.

Within the context of this specification, each term or phrase below will include the following meaning or meanings. Additional terms are defined elsewhere in the specification.

Figure 2A:
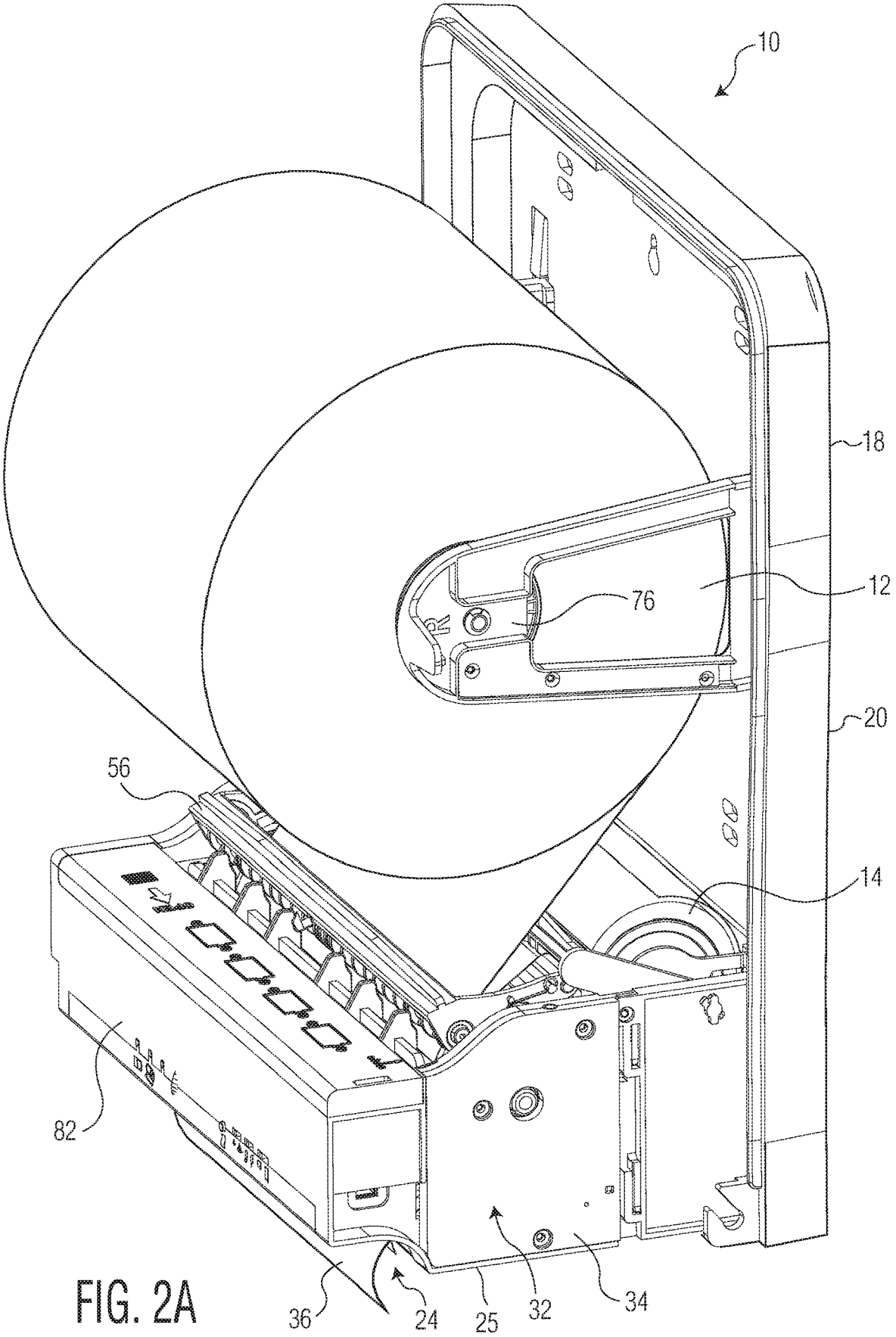
FIG. 2A is a perspective view of the towel dispenser of FIG. 1 with the front cover removed.
Figure 2B:
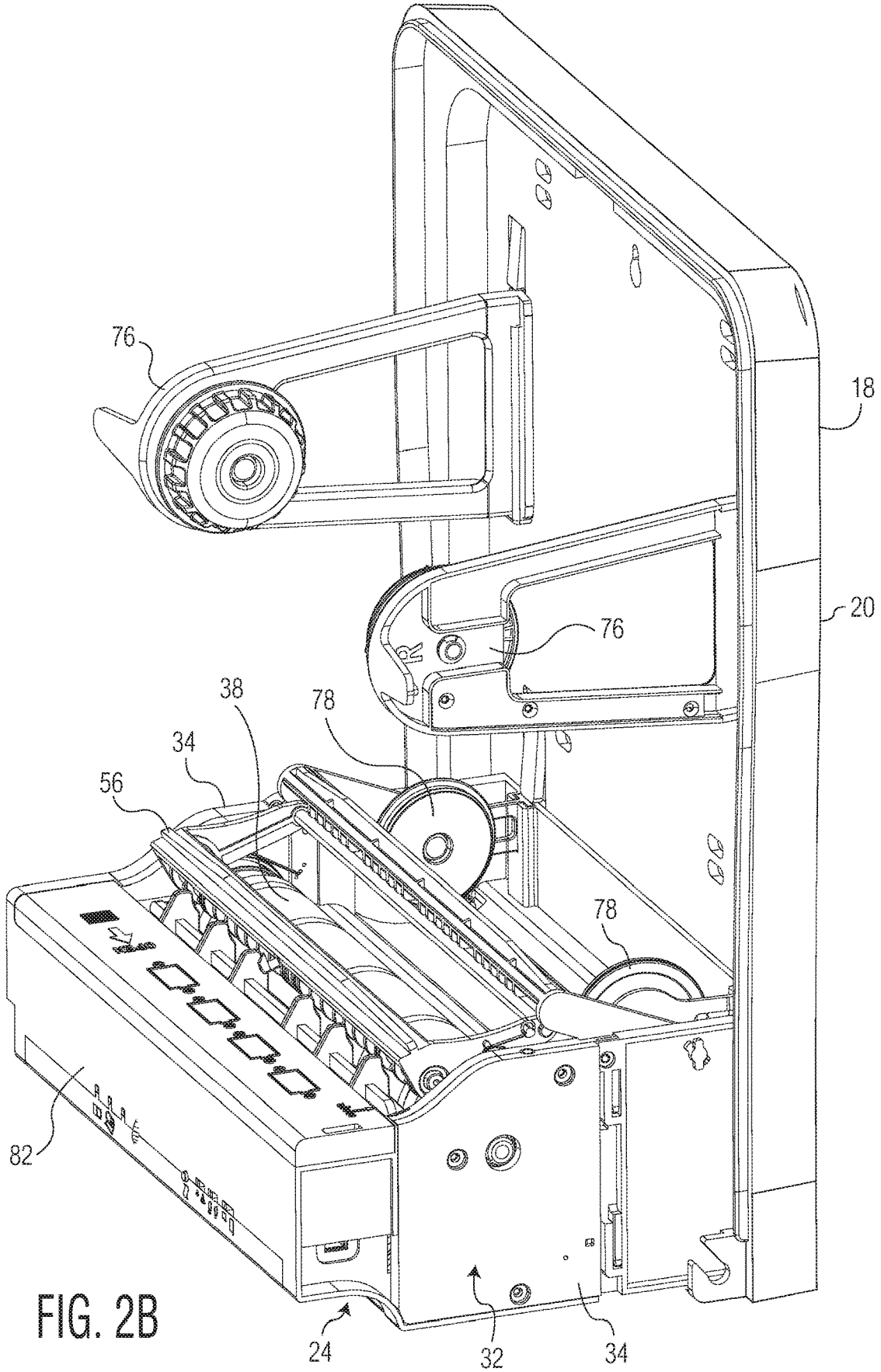
FIG. 2B is a perspective view of the towel dispenser of FIG. 2A with the rolls of web material removed.
Figure 2C:
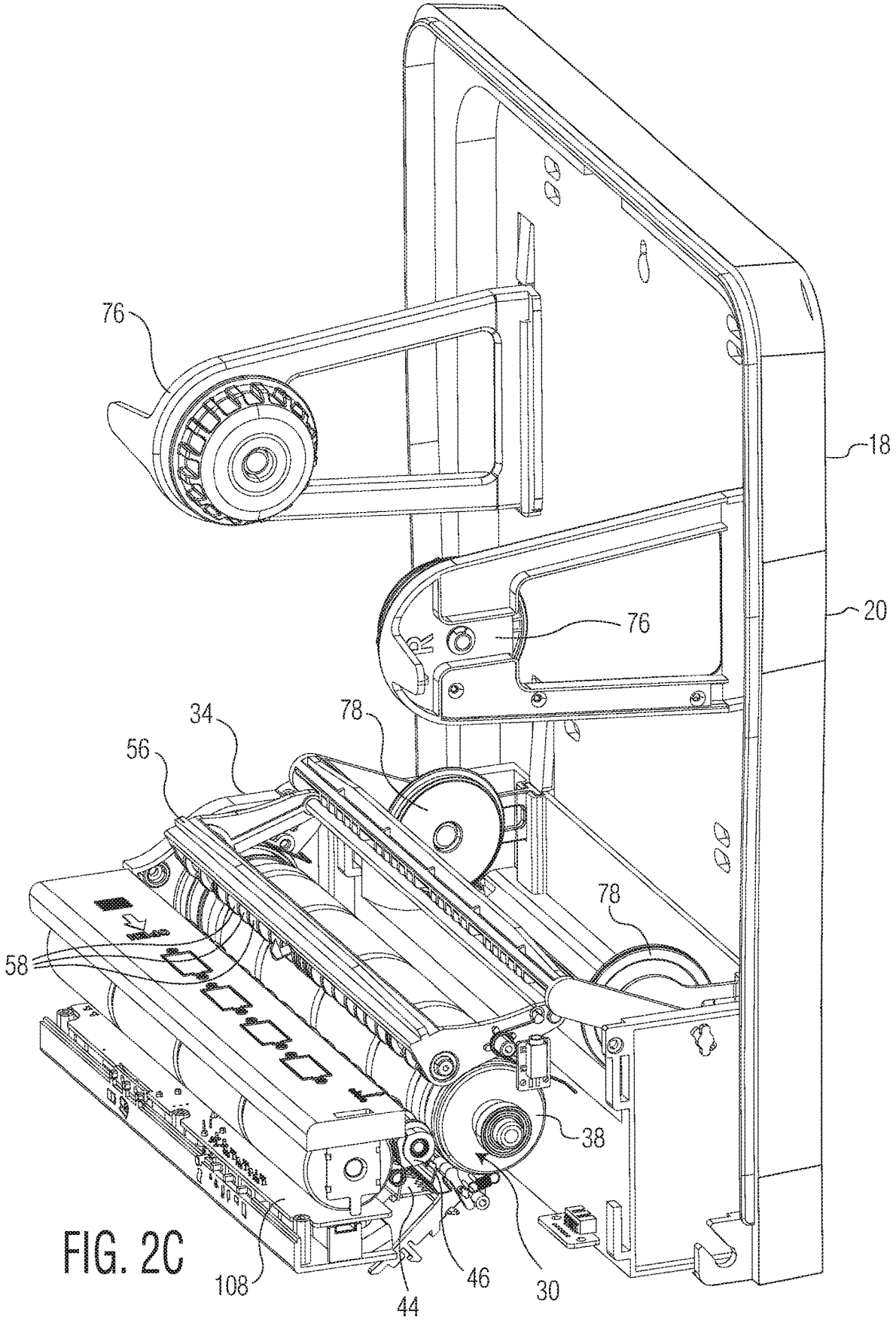
FIG. 2C is a perspective view of the towel dispenser of FIG. 2B with a side wall removed.

Referring particularly to FIGS. 1-2C, an embodiment of a towel dispenser 10 according to the present disclosure is illustrated. FIG. 1 depicts a perspective view of dispenser 10 including a housing 16 of any desired shape and configuration. The housing 16 can include a base 18 and a cover 22 connected to the base 18 so as to be generally releasably connected together. FIG. 2A depicts a perspective view of the dispenser 10 with the cover 22 removed, while FIG. 2B depicts the same perspective view as FIG. 2A with the rolls of web material 12 and 14 removed. FIG. 2C depicts the same perspective view as FIGS. 2A and 2B of the dispenser 10 with the cover 22 removed and also a side wall 34 of the chassis 32 removed to further show internal features of the dispenser 10. The cover 22 may include a front wall 23 and sidewalls 27 that align with sidewalls 20 of the base 18 to define an interior volume for housing the operational components of the dispenser 10, as well as the roll or rolls of web material to be dispensed, including a main web material roll 12 and, optionally, a stub web material roll 14. Any suitable conventional locking mechanism may be provided to secure the cover 22 to the base 18. The housing 16 includes a bottom underside portion 25 with a throat 24 from which the material is dispensed.

The dispenser configuration 10 illustrated in FIGS. 1-2C is merely exemplary of any number of electronic dispenser configurations known to those skilled in the art that may incorporate aspects of the present disclosure. As such, a detailed explanation of the structural and control features of the dispenser 10 are not necessary for purposes of explanation of the systems and methods of the present disclosure and will only be discussed briefly below.

The operational components of the dispenser 10 may be mounted directly onto the base 18 within the interior volume of the housing 16. In an alternative embodiment, the operational components may be connected together forming a separate removeable module which can be received in the housing 16. Such a removeable module may be readily removable from the base 18 for servicing and/or replacing components without the necessity of having to remove the entire dispenser 10 from its support surface (for example, a wall). The housing 16 may be considered as a shell into which the removeable module is inserted and removed.

Some of the internal components of the dispenser 10 include a frame or chassis 32 having left and right-side plates 34 and a dispensing mechanism 30. The dispensing mechanism 30 may include, for example, at least some of the following components: a drive assembly comprising a drive roller 38 and a pressure roller 46, a transfer mechanism that may include a transfer arm 56, a throat assembly 50 that defines the throat 24, a tear bar 44, a drive motor and gear assembly (not visible) that rotates drive roller 38, a tear signal sensor 63, and control circuitry 108.

Left and right main web material roll holders 76 hold the main roll 12. Stub web material roll holders 78 are provided for rotatably supporting the stub roll 14 in the position within the housing 16 below and rearward of the main roll 12. It should be understood that a dispenser according to the present disclosure need not be configured to dispense from a stub roll 14, and thus would not need a transfer mechanism. The dispenser 10 may be configured for dispensing from a single roll of web material. Additionally, where a stub roll 14 is included, it could be positioned in any suitable position within the housing 16.

The cutting or "tear" bar 44 may be disposed along the dispensing path of the web material upstream of the dispensing opening 24 and downstream of the nip 45 (shown in FIG. 3) between a drive roller 38 and pressure roller 46. To separate a sheet of the web material that has been dispensed from the dispenser 10, a user grasps the sheet hanging from beneath the bottom portion 25 of the housing 16 and pulls the sheet against the tear bar 44 such that the sheet tears and separates along the line defined by the tear bar 44.

The pressure roller 46 is spring biased against the drive roller 38 such that the web material passing between the nip 45 of the rollers is advanced along the dispensing path upon rotation of the drive roller 38. The throat assembly 50 defines a portion of the dispensing path and the forward portion of the dispensing throat 24.

The dispenser 10 may include an automatic transfer mechanism to transfer dispensing of the web material from the stub roll 14 to a main roll 12 when the web material on the stub roll 14 is nearly fully depleted. From an operational standpoint, this transfer mechanism can operate substantially as described in U.S. Pat. No. 6,079,305 issued on Jun. 27, 2000, with the '305 patent incorporated herein in its entirety for all purposes. Referring to FIGS. 2B and 2C, the transfer mechanism may include a transfer bar 56 with arms pivotally mounted to the housing 18, or another component of the dispenser 10. The transfer bar 56 includes a "roller" section that may be defined by a central curved ribbed section 58. The transfer bar may further include a web retention feature retaining a leading portion of the web material of the main roll 12.

The dispenser 10 may be configured to determine an amount of web material which is on the stub roll 14. For example, the dispenser 10 may include a stub roll sensing bar (not shown) which presses against the stub roll 14. As the diameter of the stub roll 14 decreases as web material is fed out from the stub roll 14, the stub roll sensing bar may transmit one or more signals (such as to control circuitry 108) indicative of the stub roll 14 diameter. Upon detection of a certain stub roll 14 diameter, the dispenser 10 may be configured to rotate the transfer bar 56 such that the leading portion of the web material of the main roll 12 held by the bar 56 is brought by the roller section 58 into contact with the web material being dispensed from the stub roll 14. This may cause the leading portion of the material of the main roll 12 to be pulled from the arm 56 and conveyed with the web material from the stub roll 14 between the nip 45 of the drive roller 38 and pressure roller 46. The "new" web material from the main roll 12 is dispensed simultaneously with the stub roll web material until the stub roll 14 is completely depleted. If no stub roll 14 is present in the dispenser 10, the transfer bar 56 and roller section 58 contact against the web material dispensed from the main roll 12. Of course, many other suitable transfer mechanisms may be employed with the dispenser 10 such as is known in the art.

A "fuel gauge" mechanism (not shown) may be affixed to the one or more components of the dispenser 10 which tracks a remaining amount of web material of the main roll 12 as the web material is depleted. For example, a bar biased against the main roll 12 may track the diameter of the roll 12 to help in determining a remaining amount of web material on the roll 12. Alternatively, the main roll 12 may be connected to one or more weight sensors which may operate to determine an amount of web material remaining on the main roll 12 by tracking a decreasing weight of the main roll 12. Upon determining, such as by the control circuitry 108, that the remaining amount of web material of the main roll 12 is suitable for moving the roll to the stub roll 14 position, the dispenser 10 may cause an alert to be communicated to maintenance personnel that the main roll 12 is depleted and should be replaced. For example, the dispenser 10 may cause an indicator light to turn on which is visible from the exterior of the housing 16. In other embodiments, the dispenser 10 may send an electronic message (e.g. text, e-mail, or other alert) to an alert receiving device to communicate with maintenance personal about the status of the main roll 12.

A drive motor and gear assembly may include components such as a drive shaft and a drive gear attached thereto that engages the shaft of the drive roller 38. Thus, upon energizing the motor, the drive roller 38 is caused to rotate, which results in conveyance of the web material disposed in the nip 45 between the pressure roller 46 and drive roller 38 along the conveying path and out of the dispensing throat 24.

The dispensing mechanism 30 may be powered by batteries contained in battery compartment 82 (see FIGS. 2A-2C). Any suitable battery storage device or location may be used for this purpose. A conductor may be disposed in contact with the battery compartment 82 for delivering power from the batteries to the control circuitry 108 and the drive motor. Alternatively, or in addition to battery power, the dispenser 10 may also be powered by a building's AC distribution system. For this purpose, a plug-in modular transformer/adapter may be provided with the dispenser 10, which connects to a terminal or power jack port for delivering power to the control circuitry 108 and associated components. The control circuitry 108 may include a mechanical or electrical switch that isolates the battery circuit upon connecting the AC adapter in order to protect and preserve the batteries.

The control circuitry 108 may also control the length of web material dispensed. Any number of optical or mechanical devices may be used in this regard. In the illustrated embodiment of the dispenser 10, an optical encoder may be used to count the revolutions of the drive roller 38, with this count being used by the control circuitry 108 to meter the desired length of the web material to be dispensed. Other systems may track the running time of the motor as the control variable, or detect perforations in the web material, and so forth.

The dispenser 10 may utilize one or more sensors disposed so as to detect the presence of a user in a first detection zone. In at least some embodiments, the dispenser 10 may utilize one or more further sensors so as to detect the presence of a user in a second detection zone and, once detected, initiate a dispense sequence. The first detection zone may be oriented in front of the dispenser housing 16. The second detection zone may be oriented at least partially underneath the dispenser housing 16.

Some exemplary sensors may include passive sensors such as photo sensors. Such photo sensors may be any one or combination of conventional photocells that react to changes in ambient light conditions. The operation of such devices is well known to those skilled in the art and need not be described in detail herein. Other exemplary passive sensing devices may include capacitive sensor systems that detects changes in a capacitive filed induced by the presence of a user within the monitored field.

Other exemplary sensors may include active sensors such as active transmitters and associated receivers that define an active detection zone. This active system may be any one or combination of well-known active sensing systems, such as an RF or IR sensing system. In a particular embodiment where the active sensing system includes an IR transmitter and an IR receiver, the IR transmitter may emit an IR beam into the active detection zone, and the IR receiver may detect IR light reflected from an object in the active detection zone. If the amount of reflected light is sufficient (above a detection threshold value), the circuitry controller initiates a dispense cycle wherein a motor drives the drive roller 38 until the predetermined number of pulses are detected by the optical encoder (drive roller revolution counter) indicating that the correct length of material has been dispensed. The user then grasps the dispensed sheet and pulls it forward to tear the sheet against the tear bar 44.

Some further embodiments of the dispenser 10 may include the capability to prevent a subsequent dispensing cycle if a sheet of web material has been dispensed but not removed. A separate "hanging sheet" detector may be provided and integrated with the control circuitry 108 for this purpose. Although, in at least some configurations, the same sensor or sensors used for detection within the active detection zone may also serve this purpose, as is known in the art.

According to some embodiments of the present disclosure, the dispenser 10 may utilize one or more passive sensors and one or more active sensors. Such sensors may be configured so as to, for each dispense cycle, first sense the presence of a user in the first detection zone with the one or more passive sensors. The presence of a user in the first detection zone may be required before the one or more active sensors are enabled to initiate a dispense sequence upon active detection of the user in the second detection zone. In a particular embodiment, the passive sensor or sensors must reset to a base state indicating the absence of a user in the first detection zone before the active sensor or sensors are enabled for a subsequent dispense sequence. This particular configuration minimizes waste of the web material in that it prevents a user from standing in front of the dispenser and initiating multiple sequential dispense operations. The user must exit the area of the first detection zone prior to a subsequent dispense sequence.

In an alternate embodiment, the control circuitry 108 may define a pre-set time period between dispense sequences. This time period may be adjusted by maintenance personnel. This feature may be in addition to the requirement that the passive sensor or sensors must be reset to a base state. For example, a time period of three seconds may be required after the passive sensor or sensors have been reset.

In a different embodiment wherein the passive sensor or sensors need not be reset to a base state, the time period may apply only to sequential activations of the active sensor or sensors. For example, a user may stand in front of the dispenser so that the passive sensor or sensors see a continual "valid" detection. However, the time period must pass between sequential detections of the active sensor or sensors. The time period may be set sufficiently long so as to discourage waste.

The dispenser 10 may include a "night sensor", such as an ambient light sensor, configured with the control circuitry 108 as a low-light sensor that shifts the dispenser to a reduced power mode in low-light conditions. In the illustrated embodiment, a photocell may be configured within the dispenser housing 16 so as to "look" through the housing and above the dispenser housing 16. The passive sensor or sensors and active sensor or sensors may be disabled by the control circuitry 108 in the low-light conditions. In certain situations, the ambient light detector function may not be desired. For this reason, a bypass switch may be provided and accessible such that maintenance personnel may bypass and deactivate the ambient light-sensing feature.

The control circuitry 108 may generally control the function of the dispenser 10. In some embodiments, the control circuitry 108 may be a centralized control unit, for example comprising a processor, or microcontroller, specially adapted circuitry configured to act in a control fashion, or the like. In such embodiments, the control circuitry 108 may be electrically connected to the various sensors and components of the dispenser 10 and configured to determine when to dispense web material, and how much, based on received inputs from the components and sensors. In other embodiments, the control circuitry 108 may comprise multiple, separate control units, each of the control units configured to make specific determinations and communicate signals to one or more other controllers. Such multiple control units may act in a coordinated fashion to control the function of the dispenser 10.

In at least some embodiments, the control circuitry 108 may be configured to cause the dispenser 10 to operate in one or more operating modes. According to aspects of the present disclosure, where the dispenser 10 is powered at least partly by one or more batteries, the dispenser 10 may at least be operable in a "normal" operating mode (sometimes referred to herein as a first operating mode) and in a "low-battery" operating mode (sometimes referred to herein as a second operating mode). In the "normal" operating mode, the control circuitry 108 operates the dispenser 10 in a standard dispensing fashion. For example, any sensors included in the dispenser 10 may be operable to communicate signals to the control circuitry 108. The control circuitry 108 may receive the signals from the sensors and be configured to actuate the dispensing mechanism 30. For example, the control circuitry 108 may activate the motor to drive the driver roller 38 (and/or other components of the dispensing mechanism 30) to dispense web material 36, from either the stub roll 14 or the main roll 12 as appropriate, according to a first set of operating instructions. As one, simple non-limiting example, the control circuitry 108 may receive signals from the one or more sensors and be configured to dispense web material 36 upon determining, based on the received signals, a presence of a user in a detection zone and/or an absence of a "hanging" sheet of web material 36 in the throat 24. Of course, in other embodiments, the control circuitry 108 can be configured to actuate the dispensing mechanism 30 according to other determinations based on received signals from the sensors, according to other well-known methods in the art.

The dispenser 10 may additionally include a battery voltage sensor (not shown). In some embodiments, the battery voltage sensor can be integral with the control circuitry 108. In other embodiments, the battery voltage sensor may be formed integral with the battery compartment 82 where the batteries are located and electrically connected to the control circuitry 108. In still further embodiments, the battery voltage sensor may represent a separate component electrically connected to both the batteries and the control circuitry 108. In any configuration, the battery voltage sensor may communicate signals relating to the output voltage value of the batteries to the control circuitry 108.

In some embodiments, the communicated signals from the battery voltage sensor is the output voltage value of the batteries. In other embodiments, the communicated signals may be a secondary information parameter, and the control circuitry 108 may determine the output voltage value of the batteries from the communicated secondary information parameter. Ultimately, the control circuitry 108 may be configured to compare the output voltage value of the batteries with one or more threshold voltage values. In some typical embodiments, the output voltage value of full batteries may be between about 6.0V and about 6.5V. In such embodiments, the control circuitry 108 may be configured to compare the output voltage value to one or more threshold voltage values of between about 4.9V and about 5.2V. Of course, the specific output voltage value and the threshold voltage value may differ in other embodiments. In general, such values will be specific to the design of the dispenser 10 and its operating power requirements.

Upon determining that the output voltage value is less than or equal to a threshold voltage value, the control circuitry 108 may be configured to cause one or more changes to the dispenser 10. In some embodiments, the control circuitry 108 may be configured to compare the output voltage value to an operating mode threshold voltage value. If the control circuitry 108 determines that the output voltage value is less than or equal to the operating mode threshold voltage value, the control circuitry 108 may be configured to change the operating mode of the dispenser 10 from the "normal" operating mode to the "low-battery" operating mode.

The control circuitry 108 may cause one or more changes in the dispenser 10 to operate in the "low-battery" operating mode. For example, the control circuitry 108 may turn off, or otherwise divert power away from, one or more components of the dispenser 10, such as one or more of the sensors—for example the described active sensors and/or passive sensors. In at least some embodiments when in the "low-battery" operating mode, the control circuitry 108 may, additionally or alternatively, actuate the dispensing mechanism 30 to dispense the web material 36 according to a second, different set of operating instructions than when operating in the "normal" operating mode. For example, in the "low-battery" operating mode the control circuitry 108 may determine to actuate the dispensing mechanism 30 to dispense sheets of the web material 36 according to signals from less than all of the sensors used to determine when to dispense sheets of web material 36 when operating in the "normal" operating mode. Where such signals are not used, such sensors may be turned off, thereby helping to conserve power in the "low-battery" operating mode relative to the "normal" operating mode and thus extend the useful operating life of the dispenser 10.

In addition to changing how to determine to dispense additional lengths of web material 36 when in the "low-battery" operating mode, the control circuitry 108 may further be configured to dispense a different length of web material 36 when in the "low-battery" operating mode than when in the "normal" operating mode. For example, after determining to dispense an additional length of web material 36, when in the "normal" operating mode, the control circuitry 108 may dispense a first length of web material 36. The first length of web material 36 may be sufficiently long such that the web material 36 hangs from the throat 24 of the dispenser 10 for a first distance. The first distance may generally be long enough to provide a user with a useful sheet of web material 36 upon severing the web material 36. However, in the "low-battery" operating mode, the control circuitry 108 may dispense a second length of web material 36. This second length of web material 36 is generally less than the first length of web material 36. Accordingly, the second length of web material 36 is such that the web material 36 hangs from the throat 24 of the dispenser 10 for a second distance, which is generally less than the first distance. In such embodiments, with the second length of the web material 36 being less than the first length of web material 36, the control circuitry 108 only need operate the dispensing mechanism 30 for a shorter period of time to dispense the second length of web material 36, relative to the first length of web material 36. This difference between the "low-battery" operating mode and the "normal" operating mode helps to conserve power and extend the useful operating life of the dispenser 10.

In at least some of the embodiments contemplated by the present disclosure, the tear bar 44 of the dispenser 10 may be moveable from a tear bar primary position to a tear bar secondary position. For example, the tear bar 44 may be connected to a tear bar actuator 48 operable to move the tear bar 44 from the primary position to the secondary position. The tear bar actuator 48 may further maintain the position of the tear bar 44, for example in the primary position or in the secondary position, between instances where the tear bar actuator 48 moves the tear bar 44 from the primary position to the secondary position. In such embodiments, the control circuitry 108 may be configured to compare the output voltage value to a tear bar threshold voltage value. If the control circuitry 108 determines that the output voltage value is less than or equal to the tear bar threshold voltage value, the control circuitry 108 may actuate the tear bar actuator 48 to move the tear bar 44 from the tear bar primary position to the tear bar secondary position. As will be discussed in more detail below, the dispenser 10 may conserve energy at least in part by having the tear bar disposed in the secondary position which can allow for manual dispensing of the web material 36 by a user.

Figure 3:
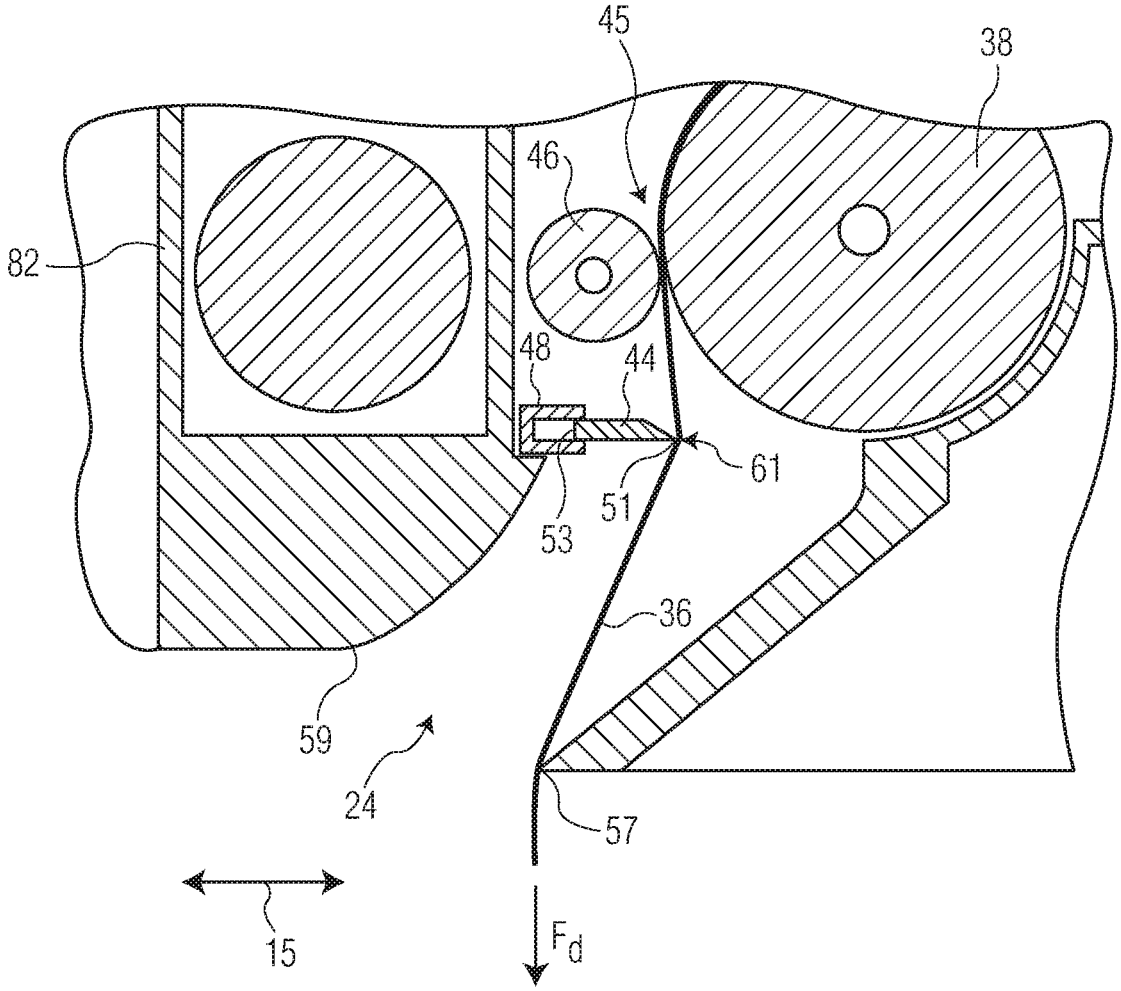
FIG. 3 is a cross-section view of a portion of the towel dispenser of FIG. 1 depicting aspects of a dispensing mechanism and a cutting bar in a primary position, according to aspects of the present disclosure.

FIG. 3 depicts a cross-section of a portion of the dispenser 10 depicting the tear bar 44 in the primary position. The tear bar 44 has a length extending from the tear bar back edge 53 to the tear bar cutting edge 51, which is sharp and operates to sever the web material 36. As can be seen, when the tear bar 44 is in the primary position, the cutting edge 51 intersects the path that the web material 36 follows within the dispenser 10 when the web material 36 is subjected to a downward force such that the web material 36 would contact the cutting edge 51.

FIG. 3 depicts the web material 36 with an applied a downward force, denoted by arrow Fd. Due to the positional configuration of the cutting edge 51, the rear edge 57 of the throat 24, and the nip 45 between the drive roller 38 and the pressure roller 46, the resulting tension on the web material 36 causes the web material 36 to intersect and contact the cutting edge 51. Where the downward force on the web material 36 is sufficiently great, the cutting edge 51 will sever the web material 36, producing an individual sheet of the web material 36. Aside from allowing a user to sever an individual sheet of web material 36 with a downward force on the web material 36 hanging in the throat 24, such a configuration may also prevent a user from "stripping" additional and/or uncontrolled lengths web material 36 from the dispenser 10. For example, in configurations where the cutting edge 51, the rear edge 57 of the throat 24, and the nip 45 are disposed such that a downward force on the web material does not cause the web material 36 to intersect and contact the cutting edge 51, a large enough downward force on the web material 36 can be sufficient to overcome the internal resistance in the drive roll 38 (and other components of the dispensing mechanism 30) such that a user could pull web material 36 from the dispenser 10 in an un-metered fashion, e.g. in a manner uncontrolled by the dispenser 10, without cutting the web material 36 on the tear bar 44.

FIG. 3, however, depicts one possible positional configuration of the cutting edge 51, the rear edge 57 of the throat 24, and the nip 45 suitable for producing an anti-stripping function in the dispenser 10, in that they are disposed in relation to each other whereby a downward force on the web material 36 causes the web material 36 to intersect and contact the cutting edge 51. In the embodiment of FIG. 3, the cutting edge 51 is located laterally offset from both of the rear edge 57 of the throat 24 and the nip 45. That is, none of the cutting edge 51, the rear edge 57 of the throat 24*k*, and nip 45 align vertically. Further, the cutting edge 51 is disposed facing the base 18 and is located closer to the base 18 than either of the rear edge 57 of the throat 24 and the nip 45. The cutting edge 51 may be considered facing the base 18 because the cutting edge 51 is closer to the base 18 than the tear bar back edge 53. Such a configuration creates an inflection point 61 along the path the web material 36 follows within the dispenser 10 when subjected to a downward force. Accordingly, a downward force on the web material 36 hanging in the throat 24 produces a corresponding force between the web material 36 and the cutting edge 51 at the inflection point 61, resulting in a severing of the web material 36. In other contemplated embodiments, such an anti-stripping function may be accomplished by ensuring that the cutting edge 51, when facing the base 18, is located closer to the base 18 than at least one of the rear edge 57 of the throat 24 and the nip 45. Some positional configurations of the cutting edge 61, the rear edge 57, and the nip 45 in these embodiments may still allow for the cutting edge 51 to intersect the path of the web material 36 follows, forming an inflection point 61 at the cutting edge 51 of the tear bar 44.

Other positional configurations of the cutting edge 51, the rear edge 57 of the throat 24, and the nip 45 between the drive roller 38 and the pressure roller 46 are contemplated by the present disclosure which result in an anti-stripping function. For example, instead of the configuration as shown in FIG. 3, the cutting edge 51 may face the cover 22 and be located closer to the cover 22 than either of the rear edge 57 of the throat 24 and the nip 45. In at least some of these embodiments, the cutting edge 51 may further be disposed closer to the cover 22 than the front edge 59 of the throat 24. The cutting edge 51 may be considered facing the cover 22 because the cutting edge 51 is closer to the cover 22 than the tear bar back edge 53. Such a configuration also causes path the web material 36 follows to intersect the cutting edge 51, forming an inflection point at the cutting edge 51, such that the web material 36 contacts the cutting edge 51 when the web material 36 is subjected to a downward force.

One disadvantage of positioning the cutting edge 51 such that it intersects the path that the web material 36 follows within the dispenser 10 when subjected to a downward force is that when the output voltage value of the batteries drops to a level insufficient to power the dispensing mechanism 30, a user would be unable to dispense any web material 36 manually. For instance, if a user were to try to pull web material 36 manually from the dispenser 10, the web material 36 would become severed by the tear bar 44. One solution to allow for a longer useful operating life of the dispenser 10 when operating on battery power is for the control circuitry 108 to cause the tear bar 44 to move from the primary position to a secondary position.

Figure 4:
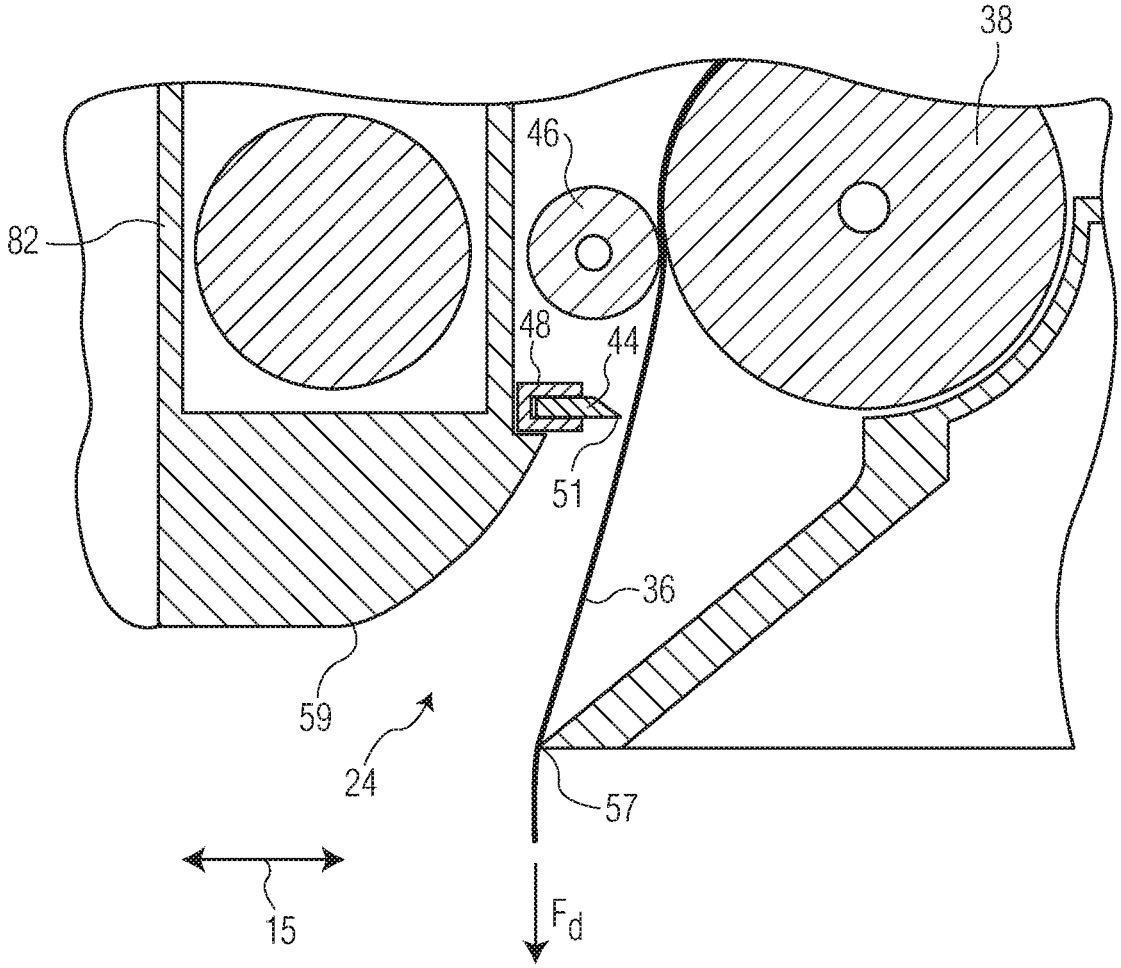
FIG. 4 is a cross-section view of a portion of the towel dispenser of FIG. 3 depicting aspects of a dispensing mechanism and a cutting bar in a secondary position, according to aspects of the present disclosure.

FIG. 4 is a cross-section of a portion of the dispenser 10 depicting the tear bar 44 in the secondary position. As with FIG. 3, FIG. 4 depicts the web material 36 with an applied downward force, denoted by arrow Fd. As shown, when in the secondary position as in FIG. 4, the cutting edge 51 of the tear bar 44 does not intersect the path that the web material 36 follows within the dispenser 10, and thus the web material 36 does not contact the cutting edge 51, when the web material 36 is subjected to a downward force. For example, where the cutting edge 51 faces the base 18, the cutting edge 51 may be disposed closer to the cover 22 than at least one of the rear edge 57 of the throat 24 and the nip 45 when the tear bar 44 is in the secondary position. In these positional configurations of the cutting edge 51, the rear edge 57, and the nip 45, there is no inflection point 61 formed in the path the web material 36 follows at the cutting edge 51. In further of these embodiments, the cutting edge 51 may be disposed closer to the cover 22 than both of the rear edge 57 of the throat 24 and the nip 45. Alternatively, where the cutting edge 51 faces the cover 22, the cutting edge 51 may be disposed closer to the base 18 than the nip 45 when the tear bar 44 is in the secondary position. In further of these embodiments, the rear edge 57 of the throat 24 may still be disposed closer to the base 18 than the cutting edge 51.

In such embodiments, a user may be able to manually pull lengths of web material 36 from the dispenser 10 in an un-metered fashion by pulling on the web material 36 with a sufficiently strong downward force. When in the secondary position, the cutting edge 51 may be disposed in a location where the web material 36 can still contact the cutting edge 51 when the web material 36 is pulled at least partly in a transverse direction 15. In this way, a user may manually strip lengths of the web material 36 when the tear bar 44 is in the secondary position and also still easily sever the web material 36 to form an individual sheet. Such a configuration may help to extend the battery life of the dispenser 10 by not requiring operation of the dispensing mechanism 30 in order for a user to obtain a suitable length of web material 36 from the dispenser 10.

Such a configuration is particularly useful where the internal resistance of the dispensing mechanism 30 is insufficient to prevent un-metered dispensing of the web material 36. For example, in some embodiments of the present disclosure, the strength of the web material 36 is stronger than the internal resistance of the dispensing mechanism 30 such that a strong enough downward force on the web material 36 is sufficient to overcome the internal resistance of the dispensing mechanism 30 and allow the web material 36 to be pulled from the main and/or stub rolls 12, 14. In such embodiments, when transitioning from the "normal" operating mode to the "low-battery" operating mode, no change to the dispensing mechanism 30 may be needed to allow for un-metered dispensing of the web material 36.

Other dispensers 10 according to the present disclosure, however, may have sufficient internal resistance in the dispensing mechanism 30 to prevent un-metered dispensing of the web material 36. For example, the internal resistance of such dispensing mechanisms 30 may be greater than the strength of the web material 36 whereby a sufficiently strong downward force on the web material 36 would cause the web material 36 to break before the internal resistance of the dispensing mechanism 30 would be overcome to allow for un-metered dispensing of the web material 36. In such embodiments, the dispensing mechanism 30 may include a one-way clutch to disconnect the drive roller 38 from other components of the dispensing mechanism 30 to lower the resistance of the dispensing mechanism 30 and allow for un-metered dispensing of the web material 36. The one-way clutch may be engaged by the control circuitry 108 when transitioning from the "normal" operating mode to the "low-battery" operating mode.

According to aspects of the present disclosure, the tear bar 44 may be connected to a tear bar actuator 48 to effectuate the movement of the tear bar 44 from the primary position to the secondary position. The control circuitry 108 may be electrically connected to the tear bar actuator 48 and may be configured to actuate the tear bar actuator 48 in order to cause the tear bar 44 to move from the primary position to the secondary position. Of course, the control circuitry 108 may also actuate the tear bar actuator 48 to cause the tear bar 44 to move from the secondary position to the primary position. The tear bar actuator 48 may further operate to maintain the tear bar 44 in the primary position or in the secondary position between instances where the tear bar actuator 48 moves the tear bar 44 from the primary position to the secondary position.

In at least some embodiments, the tear bar actuator 48 may be configured to translate the tear bar 44 from the primary position to the secondary position (as shown in FIGS. 3 and 4). In such embodiments, the tear bar actuator 48 may comprise an electromechanical solenoid or the like. When causing the tear bar 44 to move from the primary position to the secondary position, the control circuitry 108 may activate (or deactivate) the tear bar actuator 48, thereby causing the tear bar 44 to translate. Likewise, the control circuitry 108 may deactivate (or activate) the tear bar actuator 48 to cause the tear bar 44 to translate from the secondary position to the primary position.

Figure 5:
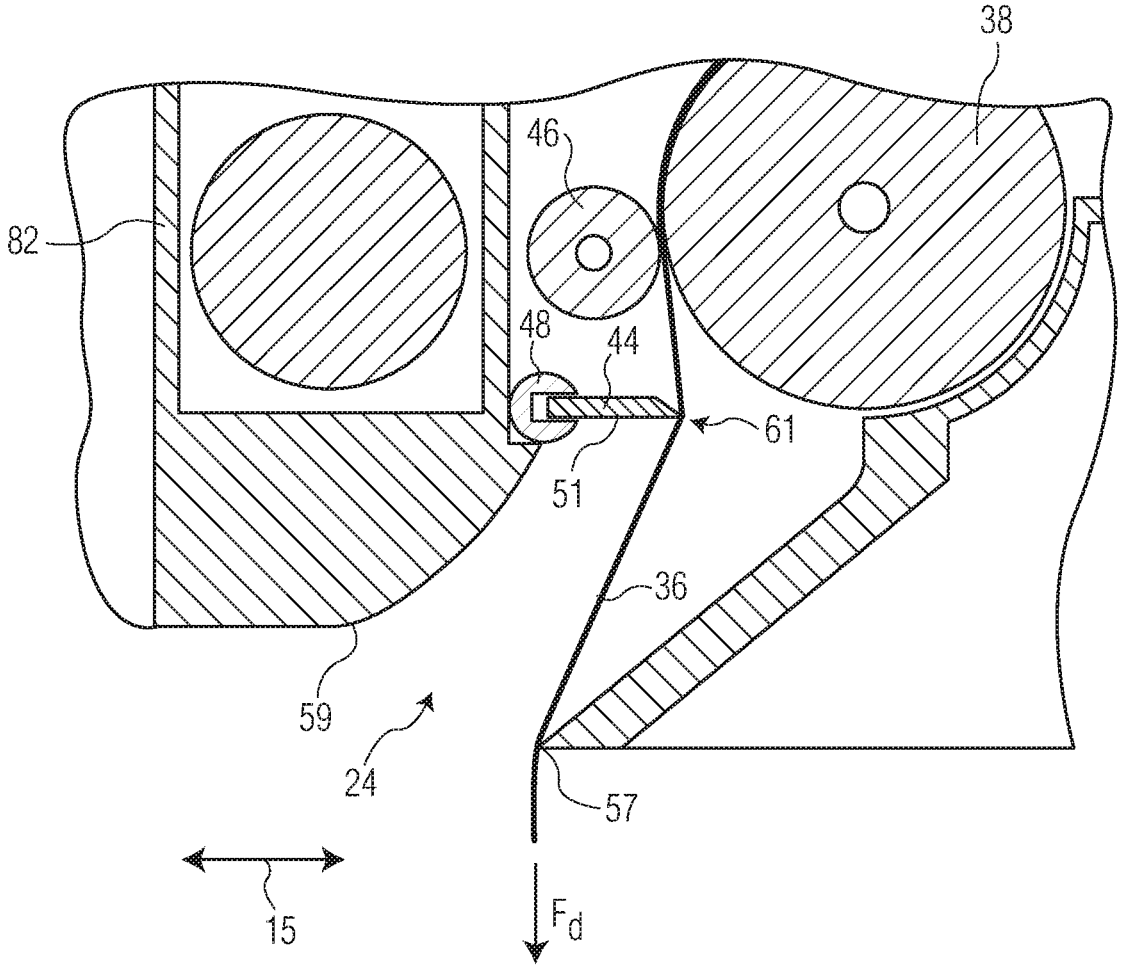
FIG. 5 is a cross-section view of a portion of the towel dispenser of FIG. 1 depicting aspects of a dispensing mechanism and a cutting bar in a primary position, according to aspects of the present disclosure.
Figure 6:
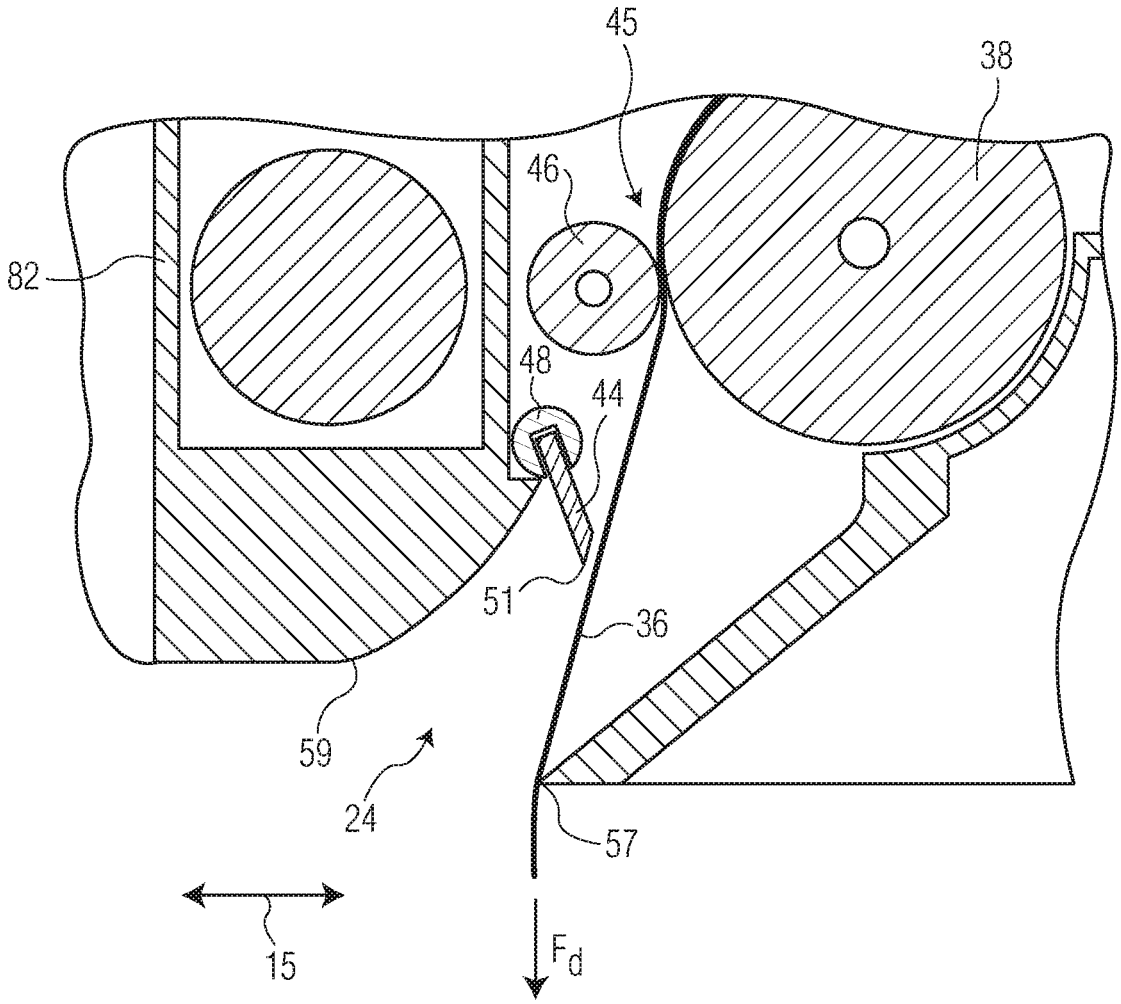
FIG. 6 is a cross-section view of a portion of the towel dispenser of FIG. 5 depicting aspects of a dispensing mechanism and a cutting bar in a secondary position, according to aspects of the present disclosure.
Figure 7:
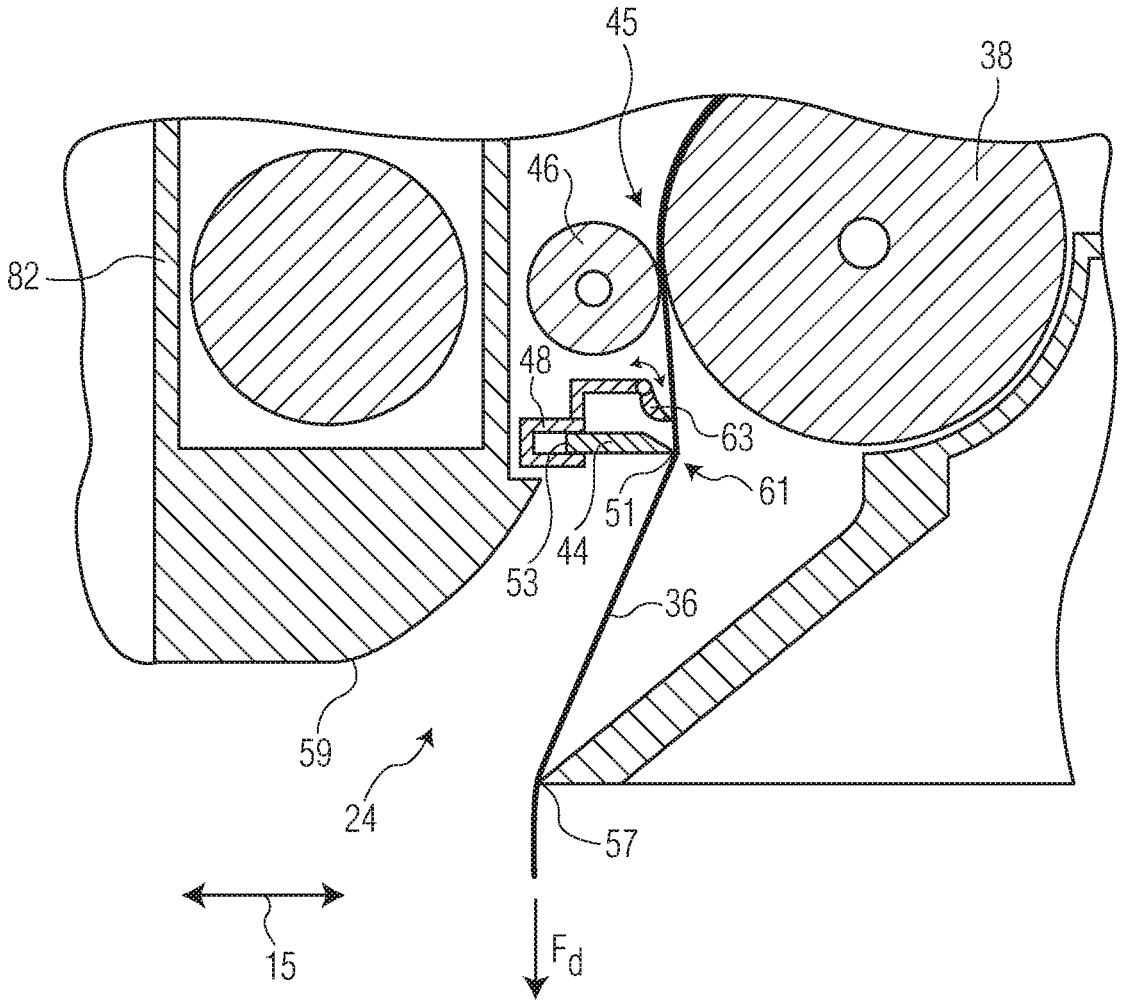
FIG. 7 is a cross-section view of a portion of the towel dispenser of FIG. 1 depicting aspects of a dispensing mechanism, a cutting bar in a primary position, and a tear signal sensor, according to aspects of the present disclosure.
Figure 8:
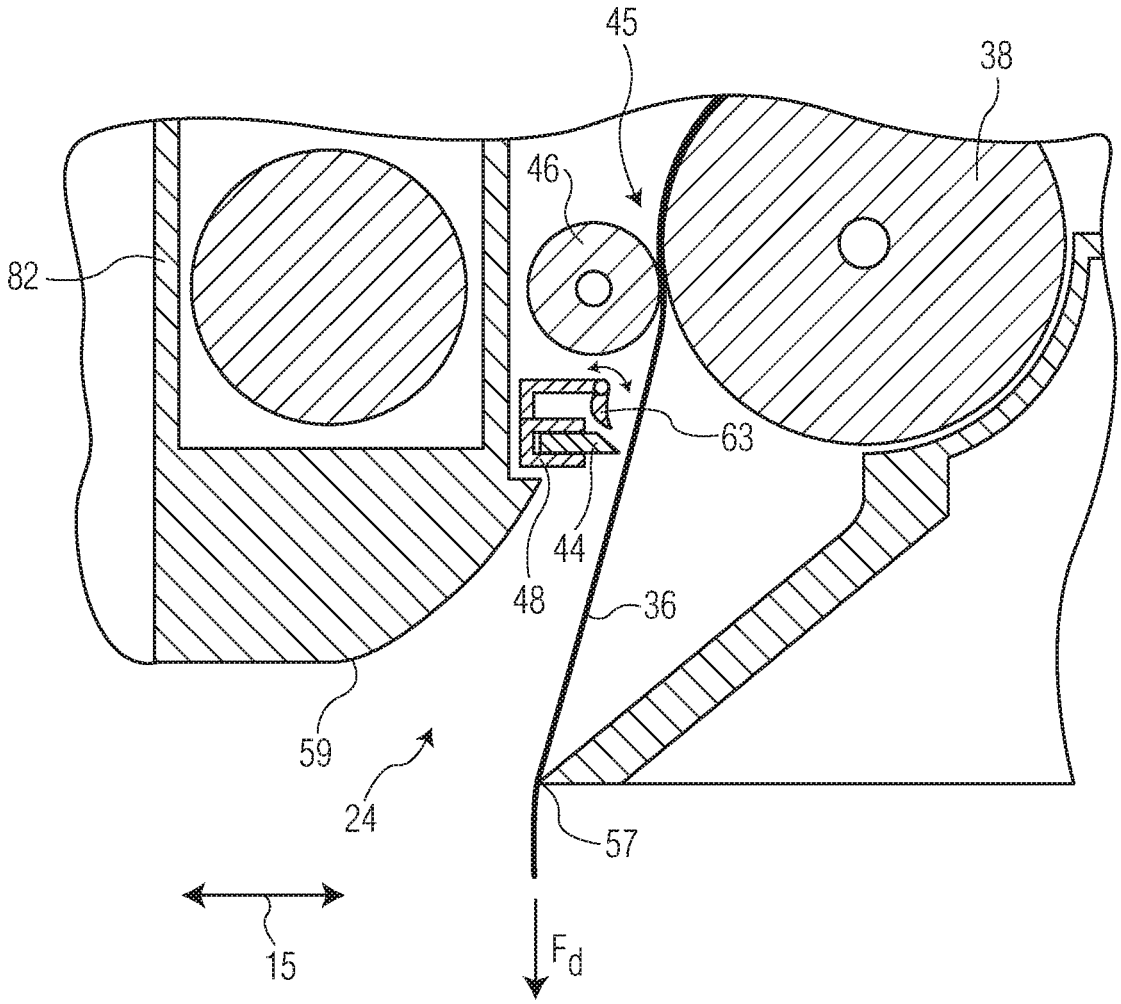
FIG. 8 is a cross-section view of a portion of the towel dispenser of FIG. 7 depicting aspects of a dispensing mechanism, a cutting bar in a secondary position, and a tear signal sensor, according to aspects of the present disclosure.

In other embodiments, the tear bar actuator 48 may be configured to rotate the tear bar 44 from the primary position to the secondary position, as shown in FIGS. 5 and 6. In such embodiments, the tear bar actuator 48 may comprise a rotary actuator, and the control circuitry 108 may activate (or deactivate) the tear bar actuator 48 to cause the tear bar 44 to rotate from the primary position to the secondary position. In still further embodiments, other mechanical and/or electromechanical means may be employed to move the tear bar from the primary position to the secondary position. Likewise, the control circuitry 108 may deactivate (or activate) the tear bar actuator 48 to cause the tear bar 44 to rotate from the secondary position to the primary position.

According to some embodiments of the present disclosure, the control circuitry 108 may be configured to compare the output voltage value of the batteries to both of the operating mode threshold voltage value and the tear bar voltage value. Such embodiments may be particularly useful for extending the useful operating life of the dispenser 10 while still allowing users to obtain useful lengths of sheets of web material from the dispenser 10. For example, where the output voltage value of the batteries falls below both of the operating mode threshold voltage value and the tear bar threshold voltage value, the control circuitry 108 may change the operating mode of the dispenser 10 from the "normal" operating mode to the "low-battery" operating mode as well as move the tear bar 44 from the tear bar primary position to the tear bar secondary position. In such embodiments, when the control circuitry 108 determines to dispense a length of the web material 36, the control circuitry 108 will dispense the shorter second length of web material. With the tear bar 44 located in the secondary position, a user would be able to grasp the length of web material 36 hanging from the throat, and manually strip web material 36 from the dispenser 10 until a useful length has been obtained. The user may then sever the web material 36 on the tear bar 44 located in the tear bar secondary position. Such a combination of features, although not required in every contemplated embodiment, may perform particularly well in terms of helping to conserve power to extend the useful operating life of the dispenser 10 as well as providing users with a convenient operating experience. In at least some of these embodiments, the tear bar threshold voltage value and the operating mode threshold voltage value may be the same.

According to further aspects of the present disclosure, the dispenser 10, in some embodiments, may additionally comprise a tear signal sensor 63. Such a tear signal sensor 63 may be a sensor electrically coupled to the control circuitry 108 and configured to communicate signals to the control circuitry 108 when actuated. As shown in FIGS. 7-10, the tear signal sensor 63 may be a rotatable pawl or the like and may be disposed proximate the tear bar 44 such that as the web material 36 approaches the tear bar 44, the web material 36 contacts and actuates the tear signal sensor 63. According to one illustrative example, a user may pull on the web material 36 hanging from the throat 24, and the web material 36 may move to press against the tear bar 44. Prior to contacting the tear bar 44, the web material 36 contacts the tear signal sensor 63, causing some positional displacement of the tear signal sensor 63 with respect to a resting position of the tear signal sensor 63. In the embodiments of FIGS. 7-10, the tear signal sensor 63 may represent a rotation sensor and be configured to rotate about a point when contacted by the web material 36. However, in other embodiments, the tear signal sensor 63 may be any other suitable type of sensor.

The tear signal sensor 63 may be configured to communicate signals relating to its positional displacement to the control circuitry 108, or alternatively may communicate a signal when the positional displacement becomes greater than a threshold displacement. In any configuration, the control circuitry 108 may use the signal(s) communicated from the tear signal sensor 63, optionally in conjunction with signals from one or more other sensors, to make a determination about dispensing additional lengths of web material 36.

In some embodiments, the tear signal sensor 63 may be connected to the tear bar 44 and/or the tear bar actuator 48. For example, the tear signal sensor 63 may be seen located in a secondary position, along with the tear bar 44, in FIG. 8. Accordingly, in such embodiments, when the control circuitry 108 causes the tear bar 44 to move from the primary position to the secondary position, the tear signal sensor 63 will move along with the tear bar 44. In such embodiments, the tear signal sensor 63 may remain in position to be actuated when the web material 36 is pressed against the tear bar 44.

Accordingly, the tear signal sensor 63 may remain useful in such configurations in communicating signals to the control circuitry 108 for use by the control circuitry 108 in determining to dispense additional lengths of web material 36.

In other embodiments, the tear signal sensor 63 may not be connected to the tear bar 44 and/or the tear bar actuator 48. For example, the tear signal sensor 63 is shown unconnected to the tear bar 44 and the tear bar actuator 48 in FIGS. 9 and 10. In such embodiments, then, when the control circuitry 108 causes the tear bar 44 to move from the primary position to the secondary position, the tear signal sensor 63 will not move along with the tear bar 44. In such embodiments, the tear signal sensor 63 may still be in a position whereby the tear signal sensor 63 is actuated when the web material 36 is brought into contact with the tear bar 44. Accordingly, the tear signal sensor 63 may remain useful in such configurations in communicating signals to the control circuitry 108 for use by the control circuitry 108 in determining to dispense additional lengths of web material 36.

Figure 9:
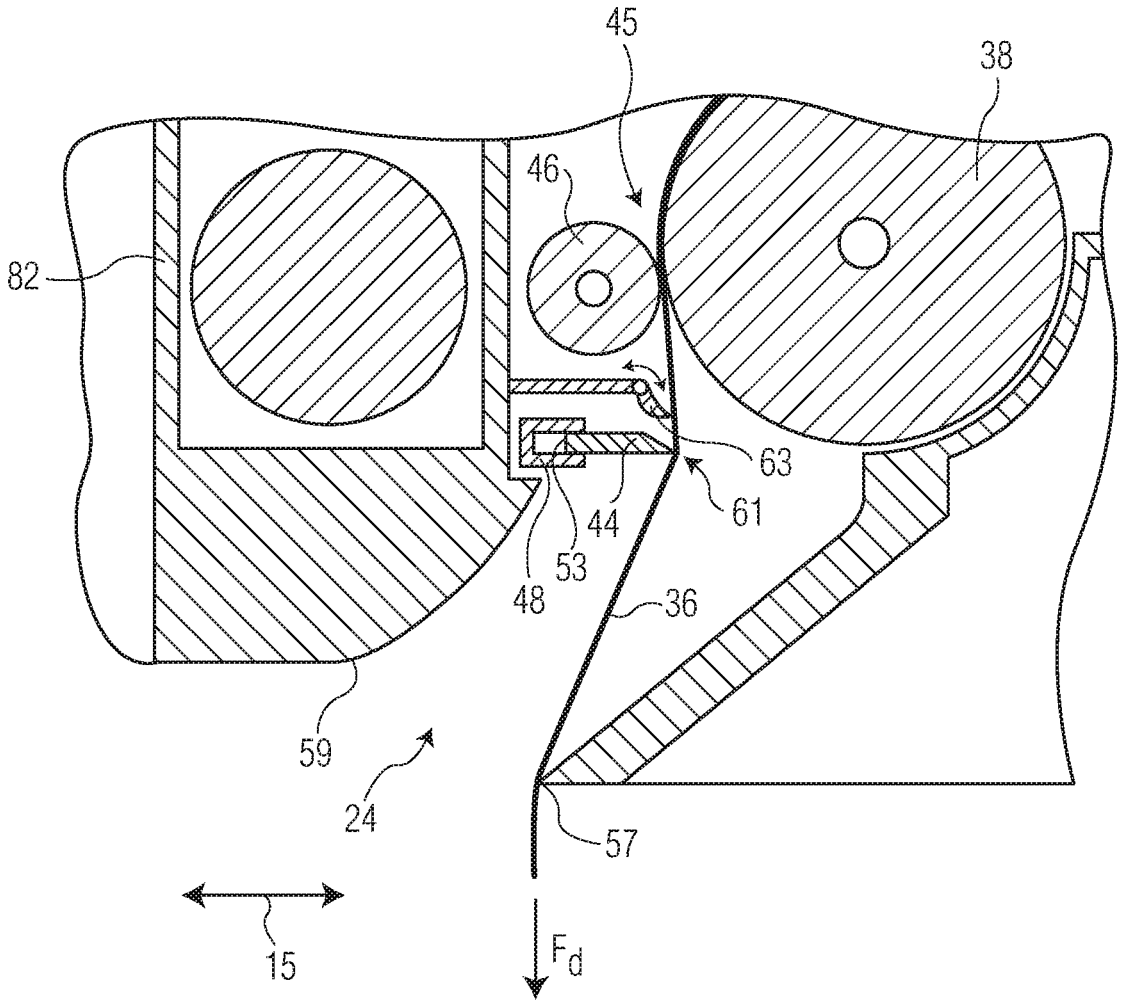
FIG. 9 is a cross-section view of a portion of the towel dispenser of FIG. 1 depicting aspects of a dispensing mechanism, a cutting bar in a primary position, and a tear signal sensor, according to aspects of the present disclosure.
Figure 10:
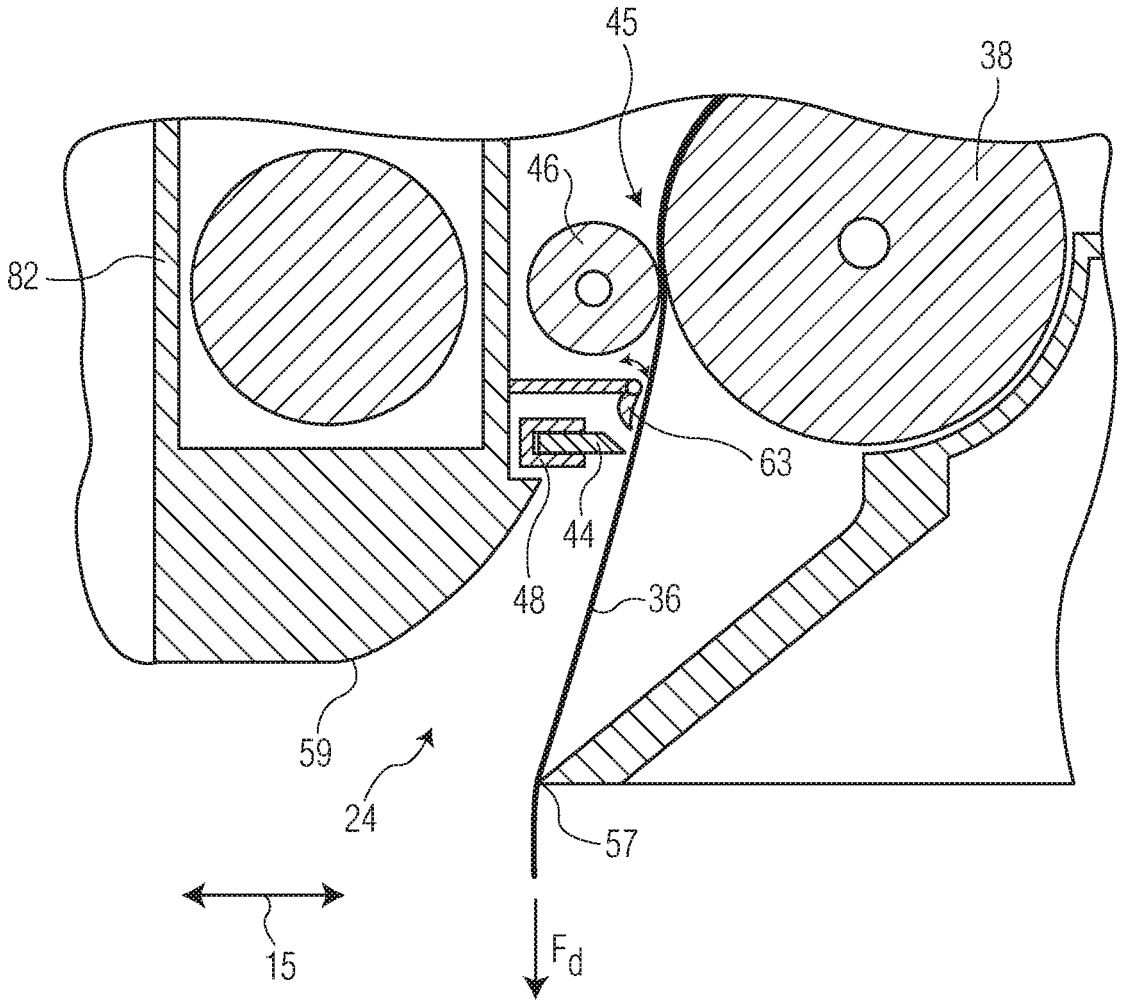
FIG. 10 is a cross-section view of a portion of the towel dispenser of FIG. 9 depicting aspects of a dispensing mechanism, a cutting bar in a secondary position, and a tear signal sensor, according to aspects of the present disclosure.
Figure 11:
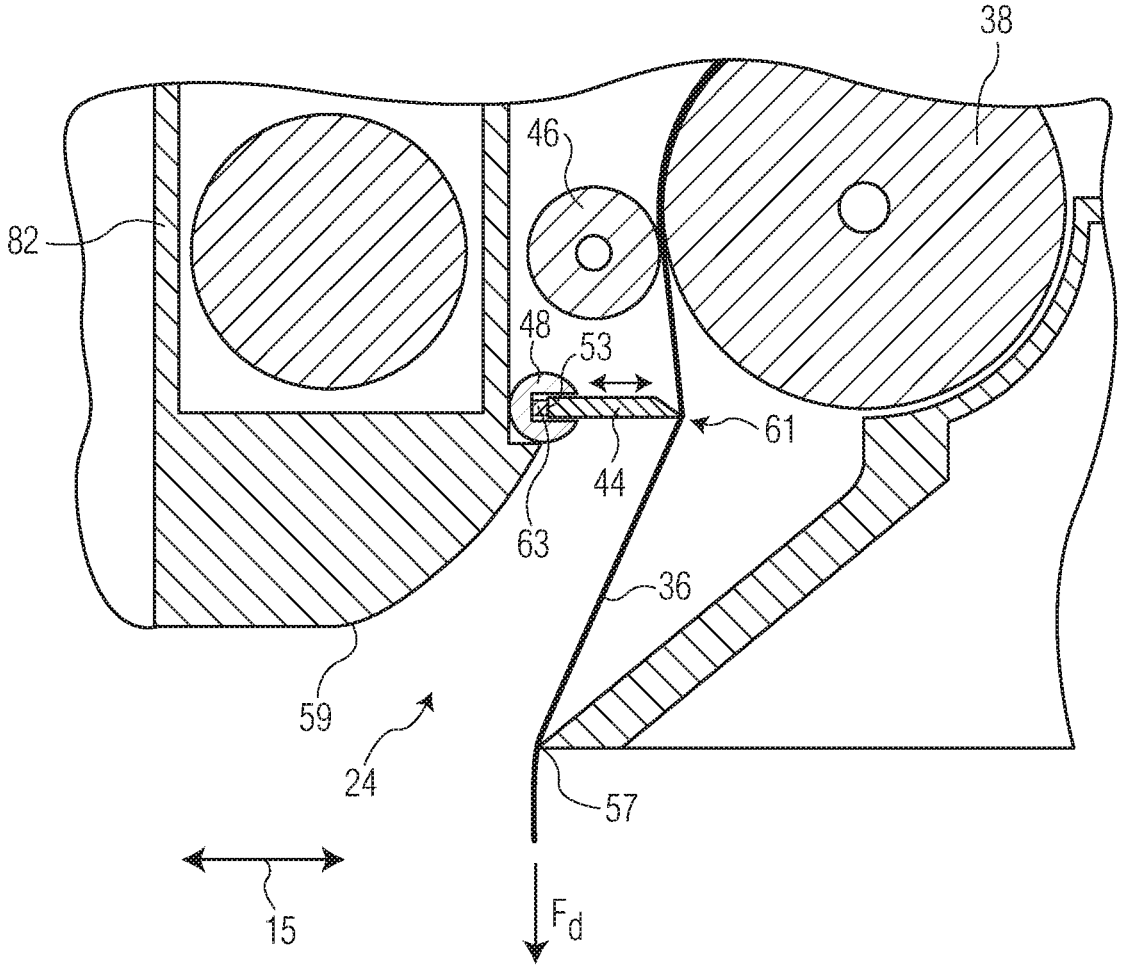
FIG. 11 is a cross-section view of a portion of the towel dispenser of FIG. 1 depicting aspects of a dispensing mechanism, a cutting bar in a primary position, and a tear signal sensor, according to aspects of the present disclosure.
Figure 12:
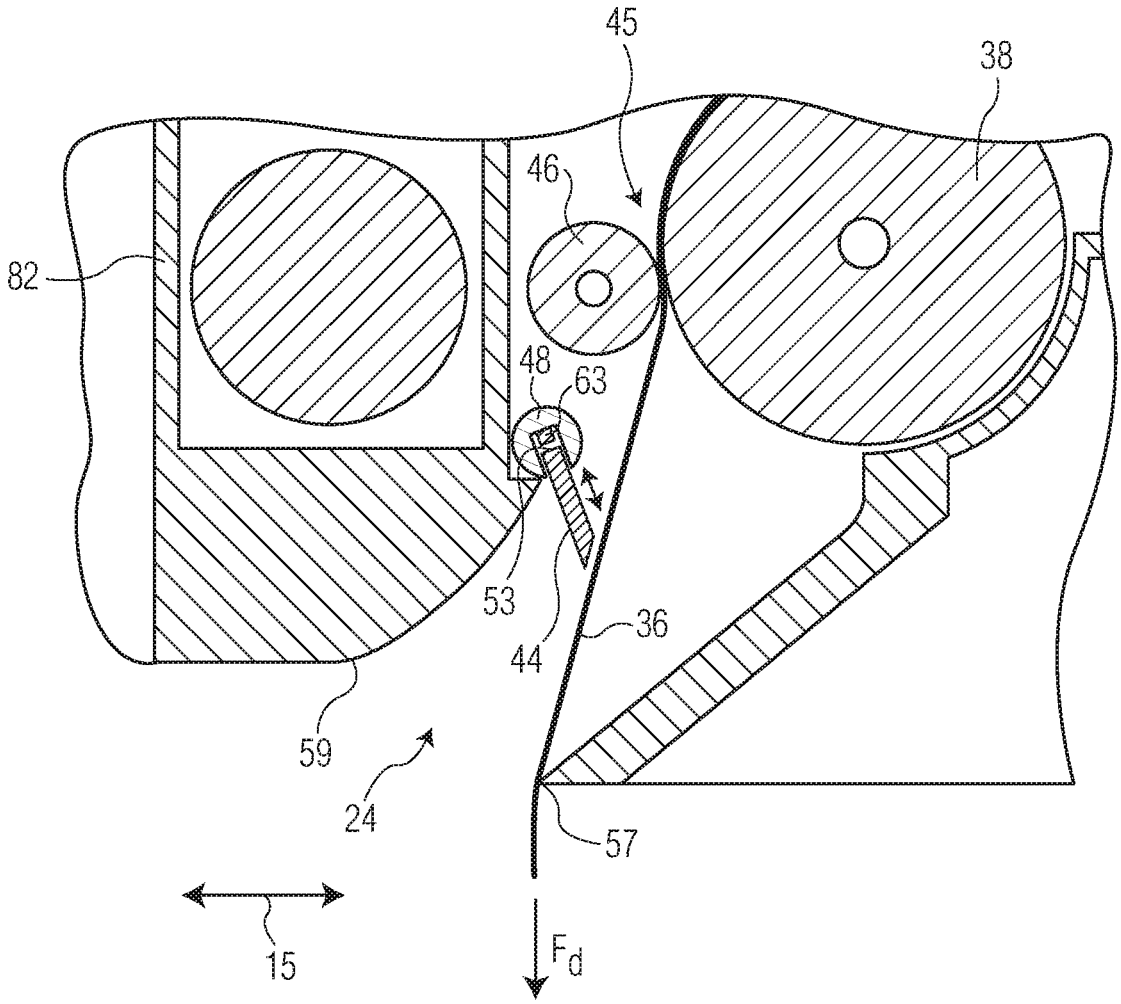
FIG. 12 is a cross-section view of a portion of the towel dispenser of FIG. 11 depicting aspects of a dispensing mechanism, a cutting bar in a secondary position, and a tear signal sensor, according to aspects of the present disclosure.

In still further embodiments, the tear signal sensor 63 may not be a rotatable pawl component as shown in FIGS. 9 and 10. Instead, as shown in FIGS. 11 and 12, the tear signal sensor 63 may be a button switch, or a pressure switch, or any other suitable component which may be triggered by contact with the tear bar 44. In some of these embodiments, the tear bar 44 may be slidably received within the actuator 48 with the tear signal sensor 63 disposed proximate the tear bar back edge 53. In other embodiments, for example where the actuator 48 is configured to translate the tear bar 44, the tear bar 44 and the tear signal sensor 63 may be disposed within a tear bar housing (not shown), and the actuator 48 may be configured to translate the tear bar housing, including both the tear bar 44 and the tear signal sensor 63.

In any of these embodiments, as the web material 36 is brought into contact with the tear bar cutting edge 51, such as by a downward force Fd on the web material 36, the pressure on the tear bar cutting edge 51 may cause the tear bar 44 to slide within the actuator 48. The tear bar 44 may slide such that the tear bar back edge 53 contacts the tear signal sensor 63, causing the tear signal sensor 63 to communicate one or more signals to the circuitry 108. Such communicated signals from the tear signal sensor 63 of FIGS. 11 and 12 may be used by the control circuitry 108, optionally in conjunction with signals from one or more other sensors, to make a determination about dispensing additional lengths of web material 36.

As described previously, when operating in the "low-battery" operating mode, the control circuitry 108 may be configured to determine to dispense additional lengths of the web material 36 in a different fashion than when operating in the "normal" operating mode. For example, in the "low-battery" operating mode, the control circuitry 108 may be configured to determine to dispense additional lengths of web material 36 based on signals from less than all of the sensors which are used to determine to dispense additional lengths of web material 36 when in the "normal" operating mode. In at least some contemplated embodiments, in the "low-battery" operating mode, the control circuitry 108 may be configured to determine to dispense additional lengths of web material 36 based solely on signals received from the tear signal sensor 63. Determining to dispense additional lengths of web material 36 based solely on signals received from the tear signal sensor 63 may help extend the useful operating life of the dispenser 10 when operating in such a "low-battery" operating mode configuration because other sensors may be turned off, thereby helping to conserve power. All documents cited in the Detailed Description are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by references, the meaning or definition assigned to the term in this written document shall govern.

Those skilled in the art will recognize that the present disclosure may be manifested in a variety of forms other than the specific embodiments described and contemplated herein. Specifically, the various features described with respect to the various embodiments and figures should not be construed to be applicable to only those embodiments and/or figures. Rather, each described feature may be combined with any other feature in various contemplated embodiments, either with or without any of the other features described in conjunction with those features. Accordingly, departure in form and detail may be made without departing from the scope of the present disclosure as described in the appended claims.

EMBODIMENTS

Embodiment 1: A towel dispenser for dispensing web material from a roll of web material, the towel dispenser may comprise a housing comprising a back panel and a front cover and having an internal volume so as to retain at least one roll of web material therein, an electronically powered dispensing mechanism contained within the housing for dispensing web material from the roll of web material upon actuation of said dispensing mechanism, a tear bar disposed within the housing, the tear bar comprising a tear bar back edge and a tear bar cutting edge, and a tear bar actuator coupled to the tear bar and configured to move the tear bar between a tear bar primary position and a tear bar secondary position.

Embodiment 2: The towel dispenser of embodiment 1, wherein the tear bar actuator may be configured to translate the tear bar between the tear bar primary position and the tear bar secondary position.

Embodiment 3: The towel dispenser of embodiment 1, wherein the tear bar actuator may be configured to rotate the tear bar between the tear bar primary position and the tear bar secondary position.

Embodiment 4: The towel dispenser of any of embodiments 1-3, where the towel dispenser may further comprise a drive roll and a pressure roll forming a nip and a throat having a throat front edge and a throat rear edge, wherein the tear bar cutting edge faces the back panel, and wherein when the tear bar is in the tear bar primary position, the tear bar cutting edge is disposed closer to the back panel than either the nip and the throat rear edge.

Embodiment 5: The towel dispenser of any of embodiments 1-4, wherein when the tear bar is in the tear bar secondary position, the tear bar cutting edge may be disposed closer to the front cover than at least one of the nip and the throat rear edge.

Embodiment 6: The towel dispenser of any of the embodiments 1-5, wherein the towel dispenser may further comprise control circuitry disposed within the housing and configured to actuate the dispensing mechanism.

Embodiment 7: The towel dispenser of embodiment 6, wherein the towel dispenser may further comprise a tear signal sensor disposed within the housing and configured to communicate signals to the control circuitry.

Embodiment 8: The towel dispenser of embodiment 7, wherein the tear signal sensor may be connected to the tear bar actuator such that the tear signal sensor moves when the tear bar actuator moves the tear bar from the tear bar primary position to the tear bar secondary position.

Embodiment 9: The towel dispenser of embodiment 6-8, wherein the towel dispenser may further comprise at least one battery and a battery voltage sensor, the battery voltage sensor electrically connected to the control circuitry, and wherein the control circuitry may be configured to transition the towel dispenser from a first operating mode to a second operating mode after determining that an output battery voltage value, based at least in part on signals received from the battery voltage sensor, is equal to or less than a voltage threshold.

Embodiment 10: The towel dispenser of embodiment 9, wherein the control circuitry may be configured to actuate the tear bar actuator to move the tear bar from the tear bar primary position to the tear bar secondary position after determining that the output battery voltage value is equal to or less than the voltage threshold.

Embodiment 11: The towel dispenser of any of embodiments 9-10, wherein the control circuitry may be configured to actuate the dispensing mechanism to dispense a first length of web material when operating in the first operating mode and to actuate the dispensing mechanism to dispense a second length of web material when operating in the second operating mode, the first length being greater than the second length.

Embodiment 12: The towel dispenser of any of embodiments 9-11, wherein when in the second operating mode, the control circuitry may determine to actuate the dispensing mechanism to dispense a length of web material based only on signals received from the tear signal sensor.

Embodiment 13: A towel dispenser for dispensing web material from a roll of web material, the towel dispenser may comprise a housing comprising a back panel and a front cover and having an internal volume so as to retain at least one roll of web material therein, an electronically powered dispensing mechanism contained within the housing for dispensing web material from the roll of web material upon actuation of said dispensing mechanism, a tear bar disposed within the housing, the tear bar comprising a tear bar back edge and a tear bar cutting edge, and a tear bar actuator coupled to the tear bar and configured to move the tear bar between a tear bar primary position and a tear bar secondary position, wherein when the tear bar is in the tear bar primary position, the tear bar cutting edge intersects a path the web material follows within the towel dispenser when the web material is subjected to a downward force, and wherein when the tear bar is in the tear bar secondary position, the tear bar cutting edge does not intersect the path the web material follows within the towel dispenser when the web material is subjected to a downward force.

Embodiment 14: The towel dispenser of embodiment 13, wherein the towel dispenser may further comprise control circuitry disposed within the housing and configured to actuate the dispensing mechanism and at least one battery and a battery voltage sensor, the battery voltage sensor electrically connected to the control circuitry, and wherein the control circuitry may be configured to actuate the tear bar actuator to move the tear bar from the tear bar primary position to the tear bar secondary position after determining that an output battery voltage value, based at least in part on signals received from the battery voltage sensor, is equal to or less than a voltage threshold.

Embodiment 15: The towel dispenser of any of embodiments 13-14, wherein the towel dispenser may further comprise control circuitry disposed within the housing and configured to actuate the dispensing mechanism and at least one battery and a battery voltage sensor, the battery voltage sensor electrically connected to the control circuitry, and wherein the control circuitry is configured to transition the towel dispenser from a first operating mode to a second operating mode after determining that an output battery voltage value, based at least in part on signals received from the battery voltage sensor, is equal to or less than a voltage threshold.

Embodiment 16: The towel dispenser of embodiment 15, wherein the control circuitry may be configured to actuate the dispensing mechanism to dispense a first length of web material when operating in the first operating mode and to actuate the dispensing mechanism to dispense a second length of web material when operating in the second operating mode, the first length being greater than the second length.

Embodiment 17: The towel dispenser of any of embodiments 15-16, wherein when in the second operating mode, the control circuitry may determine to actuate the dispensing mechanism to dispense a length of web material based only on signals received from the tear signal sensor.

Embodiment 18: A method of operating a towel dispenser for dispensing web material from a roll of web material, the method may comprise monitoring, with control circuitry, a battery voltage value of one or more batteries of the towel dispenser, and, after determining the battery voltage value is equal to or less than a tear bar threshold battery voltage value, moving a tear bar of the towel dispenser from a tear bar primary position within the towel dispenser to a tear bar secondary position within the towel dispenser.

Embodiment 19: The method of embodiment 18, wherein the towel dispenser may further comprise actuating, with the control circuitry, a dispensing mechanism of the towel dispenser to dispense a length of web material having a first length when operating in a first operating mode, actuating, with the control circuitry, the dispensing mechanism of the towel dispenser to dispense a length of web material having a second length, the second length being less than the first length, when operating in a second operating mode, and transitioning the dispenser from the first operating mode to the second operating mode after determining the battery voltage value is equal to or less than an operating mode threshold battery voltage value.

Embodiment 20: The method of embodiment 19, wherein the tear bar threshold battery voltage value may be the same as the operating mode threshold battery voltage value.

Embodiment 21: A method of operating a towel dispenser for dispensing web material from a roll of web material may comprise:

monitoring, with control circuitry, a battery voltage value of one or more batteries of the towel dispenser;

while the battery voltage value is greater than an operating mode threshold voltage value, operating the towel dispenser in a first operating mode, wherein while in the first operating mode the dispenser prevents un-metered dispensing of the web material;

while the battery voltage value is less than an operating mode threshold voltage value, operating the towel dispenser in a second operating mode, wherein while in the second operating mode the dispenser allows un-metered dispensing of the web material, wherein an internal resistance of a dispensing mechanism of the towel dispenser is insufficient to prevent un-metered dispensing of the web material.

Embodiment 22: The method of embodiment 21, wherein when operating in the first operating mode, the dispenser may prevent un-metered dispensing of the web material with a tear bar located in a primary position.

Embodiment 23: The method of any of the embodiments 21-22, wherein when operating in the second operating mode, the dispenser may allow un-metered dispensing of the web material with a tear bar in a secondary position.

Embodiment 24: The method of any of the embodiments 21-23, wherein the internal resistance of the dispensing mechanism is lower than a breaking strength of the web material such that the web material may be pulled from the dispenser without tearing.

Embodiment 25: The method of embodiment 21, wherein the internal resistance of the dispensing mechanism is insufficient to prevent un-metered dispensing of the web material while the towel dispenser is in the second operating mode.

Embodiment 26: The method of embodiment 25, wherein the internal resistance of the dispensing mechanism is sufficient to prevent un-metered dispensing of the web material while the towel dispenser is in the first operating mode.

Embodiment 27: The method of embodiment 25, wherein the dispensing mechanism of the towel dispenser comprises a one-way clutch.

What is claimed is:

1. A towel dispenser for dispensing web material from a roll of web material, the towel dispenser comprising:

a housing comprising a back panel and a front cover and having an internal volume so as to retain at least one roll of web material therein;

an electronically powered dispensing mechanism, including a drive roller and a drive motor, operated by one or more batteries, contained within the housing for dispensing web material from the roll of web material upon actuation of said dispensing mechanism;

a tear bar disposed within the housing, the tear bar comprising a tear bar back edge and a tear bar cutting edge;

a throat rear edge;

a tear bar actuator coupled to the tear bar and configured to move the tear bar between a tear bar primary position and a tear bar secondary position, wherein in the tear bar primary position the tear bar is configured to engage the web material to sever the web material from the roll of web material during a dispense process and in the tear bar secondary position the tear bar is configured to disengage the web material; and in response to the one or more batteries dropping to a level insufficient to power the dispensing mechanism, a battery voltage sensor, a control circuitry and the tear bar actuator are configured to cause the tear bar to move from the tear bar primary position to the tear bar secondary position to cause the throat rear edge to engage the web material to sever the web material from the roll of web material during the dispense process.

2. The towel dispenser of claim 1, wherein the tear bar actuator is configured to rotate the tear bar between the tear bar primary position and the tear bar secondary position.

3. The towel dispenser of claim 1, wherein when the tear bar is in the tear bar secondary position, the tear bar cutting edge is disposed closer to the front cover than at least one of a nip and the throat rear edge.

4. The towel dispenser of claim 1, further comprising the control circuitry disposed within the housing and configured to actuate the dispensing mechanism.

5. The towel dispenser of claim 4, further comprising a tear signal sensor disposed within the housing and configured to communicate signals to the control circuitry.

6. The towel dispenser of claim 5, wherein the tear signal sensor is connected to the tear bar actuator such that the tear signal sensor moves when the tear bar actuator moves the tear bar from the tear bar primary position to the tear bar secondary position.

7. A towel dispenser for dispensing web material from a roll of web material, the towel dispenser comprising:

a housing comprising a back panel and a front cover and having an internal volume so as to retain at least one roll of web material therein;

an electronically powered dispensing mechanism, one or more batteries, contained within the housing for dispensing web material from the roll of web material upon actuation of said dispensing mechanism;

a throat rear edge;

a tear bar disposed within the housing, the tear bar comprising a tear bar back edge and a tear bar cutting edge; and in response to the one or more batteries dropping to a level insufficient to power the dispensing mechanism, a battery voltage sensor, a control circuitry and a tear bar actuator are configured to cause the tear bar to move from a tear bar primary position to a tear bar secondary position, wherein when the tear bar is in the tear bar primary position, the tear bar cutting edge intersects a path the web material follows within the towel dispenser when the web material is subjected to a downward force, and wherein when the tear bar is in the tear bar secondary position, (1) the tear bar cutting edge does not intersect the path the web material follows within the towel dispenser when the web material is subjected to a downward force and (2) the throat rear edge intersects the path the web material follows within the towel dispenser when the web material is subjected to the downward force.

8. The towel dispenser of claim 7, further comprising:

the control circuitry disposed within the housing and configured to actuate the dispensing mechanism; and the battery voltage sensor electrically connected to the control circuitry, and wherein the control circuitry is configured to actuate the tear bar actuator to move the tear bar from the tear bar primary position to the tear bar secondary position after determining that an output battery voltage value, based at least in part on signals received from the battery voltage sensor, is equal to or less than a voltage threshold.

9. The towel dispenser of claim 7, further comprising the control circuitry disposed within the housing and configured to actuate the dispensing mechanism; and the battery voltage sensor electrically connected to the control circuitry, and wherein the control circuitry is configured to transition the towel dispenser from a first operating mode to a second operating mode after determining that an output battery voltage value, based at least in part on signals received from the battery voltage sensor, is equal to or less than a voltage threshold.

10. The towel dispenser of claim 9, wherein the control circuitry is configured to actuate the dispensing mechanism to dispense a first length of web material when operating in the first operating mode and to actuate the dispensing mechanism to dispense a second length of web material when operating in the second operating mode, the first length being greater than the second length.

11. The towel dispenser of claim 9, wherein when in the second operating mode, the control circuitry determines to actuate the dispensing mechanism to dispense a length of web material based only on signals received from the tear signal sensor.

* * * * *